US007509085B2

(12) United States Patent
Yoshinaga et al.

(10) Patent No.: US 7,509,085 B2
(45) Date of Patent: Mar. 24, 2009

(54) IMAGE FORMING APPARATUS, FIXING APPARATUS AND TONER

(75) Inventors: Hiroshi Yoshinaga, Ichikawa (JP); Shinichi Namekata, Yokohama (JP); Hiroyuki Shimada, Tokyo (JP); Masanao Ehara, Saitama (JP); Hirofumi Ogawa, Kawasaki (JP); Tadashi Ogawa, Kawasaki (JP); Ippel Fujimoto, Kawasaki (JP)

(73) Assignee: Ricoh Company, Ltd., Tokyo (JP)

( * ) Notice: Subject to any disclaimer, the term of this patent is extended or adjusted under 35 U.S.C. 154(b) by 360 days.

(21) Appl. No.: 11/337,980

(22) Filed: Jan. 24, 2006

(65) Prior Publication Data

US 2006/0165443 A1 Jul. 27, 2006

(30) Foreign Application Priority Data

Jan. 24, 2005 (JP) ..... 2005-014948

(51) Int. Cl.
*G03G 15/20* (2006.01)

(52) U.S. Cl. ..... 399/325; 399/329

(58) Field of Classification Search ..... 399/325, 399/326, 329

See application file for complete search history.

(56) References Cited

U.S. PATENT DOCUMENTS 5,832,354 A 11/1998 Kouno et al.
5,915,147 A 6/1999 Kouno et al.
6,219,520 B1 4/2001 Ehara
6,628,916 B2 9/2003 Yasui et al.
6,636,709 B2 10/2003 Furukawa et al.
6,778,790 B2 8/2004 Yoshinaga et al.
6,778,804 B2 8/2004 Yoshinaga et al.
6,785,505 B2 8/2004 Yasui et al.
6,795,681 B2 * 9/2004 Onodera et al. ..... 399/329
6,807,386 B2 10/2004 Yasui et al.
6,881,927 B2 4/2005 Yoshinaga et al.
6,892,044 B2 5/2005 Yasui et al.
7,046,950 B2 * 5/2006 Fuma et al. ..... 399/329
7,151,907 B2 * 12/2006 Yoshinaga ..... 399/329
7,209,697 B2 * 4/2007 Yoshida et al. ..... 399/329
7,313,353 B2 * 12/2007 Satoh et al. ..... 399/329
7,379,698 B2 * 5/2008 Yoshinaga ..... 399/329

(Continued)

FOREIGN PATENT DOCUMENTS

JP 09-015903 1/1997

(Continued)

*Primary Examiner*—William J Royer
(74) *Attorney, Agent, or Firm*—Harness, Dickey & Pierce, P.L.C.

(57) ABSTRACT

An image forming apparatus includes an image forming mechanism and a fixing mechanism. The fixing mechanism fixes a visible image formed by the image forming mechanism onto a recording sheet. The fixing mechanism includes a first roller, a second roller, a belt, a third roller, and an applicator. The second roller includes a first heater having a first heat capacity. The belt is looped over the first and second rollers. The third roller is arranged opposite to the first roller via the belt, includes a second heater having a heat capacity smaller than the first heat capacity of the first heater, applies a pressure to the belt and the first roller, and rotates in conjunction with a movement of the first roller via the belt. The applicator is arranged at a position in contact with the third roller and applies oil to a surface of the third roller.

16 Claims, 5 Drawing Sheets

U.S. PATENT DOCUMENTS

| | | | |
|---|---|---|---|
| 2002/0018663 | A1 | 2/2002 | Furukawa et al. |
| 2002/0067936 | A1 | 6/2002 | Yasui et al. |
| 2003/0000933 | A1 | 1/2003 | Yoshinaga et al. |
| 2003/0007813 | A1 | 1/2003 | Yasui et al. |
| 2003/0016963 | A1 | 1/2003 | Yoshinaga et al. |
| 2003/0206758 | A1 | 11/2003 | Yasui et al. |
| 2003/0215271 | A1 | 11/2003 | Yoshinaga et al. |
| 2004/0042825 | A1 | 3/2004 | Yasui et al. |
| 2005/0025539 | A1 | 2/2005 | Yoshinaga |
| 2005/0095043 | A1 | 5/2005 | Yoshinaga et al. |

FOREIGN PATENT DOCUMENTS

| | | |
|---|---|---|
| JP | 10-307496 | 11/1998 |
| JP | 11-133665 | 5/1999 |
| JP | 11-149180 | 6/1999 |
| JP | 2000-292981 | 10/2000 |
| JP | 2005-049445 | 2/2005 |

* cited by examiner

FIG. 3

| EXAMPLE | PROPERTIES OF TONER BINDER | | |
|---|---|---|---|
| | PEAK MOLECULAR WEIGHT | ACID NUMBER (mgKOH/g) | GLASS TRANSITION POINT (°C) |
| 1 | 4,000 | 10 | 55 |
| 2 | 5,200 | 8 | 60 |
| 3 | 4,500 | 15 | 62 |
| 4 | 8,000 | 7 | 57 |
| 5 | 7,000 | 7 | 58 |

FIG. 4A

FIG. 4

| FIG. 4A | FIG. 4B |
|---|---|

| EXAMPLE | WEIGHT AVERAGE PARTICLE SIZE (μm) | NUMBER AVERAGE PARTICLE SIZE (μm) | WEIGHT AVERAGE PARTICLE SIZE/ NUMBER AVERAGE PARTICLE SIZE | CIRCU-LARITY | FLUIDITY (g/ml) | LOWER-LIMIT FIXING TEMPERATURE (°C) |
|---|---|---|---|---|---|---|
| 1 | 5.5 | 4.8 | 1.15 | 0.940 | 0.30 | 150 |
| 2 | 6.8 | 6.2 | 1.10 | 0.950 | 0.35 | 150 |
| 3 | 4.9 | 4.2 | 1.17 | 0.930 | 0.44 | 160 |
| 4 | 6.0 | 4.6 | 1.30 | 0.970 | 0.25 | 155 |
| 5 | 7.5 | 6.1 | 1.22 | 0.925 | 0.23 | 160 |

FIG. 4B

| HOT OFFSET TEMPERATURE (°C) | GLOSS TEMPERATURE (°C) | HAZE | PIGMENT PARTICLE SIZE (μm) | NUMBER RATIO OF PIGMENT PARTICLE SIZE NOT SMALLER THAN 0.7 μm (%) |
|---|---|---|---|---|
| 220 | 160 | MEDIUM | 0.40 | 3.5 |
| 220 | 150 | HIGH | 0.25 | 1.0 |
| 230 | 160 | HIGH | 0.15 | 2.0 |
| 200 | 160 | MEDIUM | 0.70 | 35.0 |
| 180 | 150 | MEDIUM | 0.70 | 15.0 |

IMAGE FORMING APPARATUS, FIXING APPARATUS AND TONER

CROSS-REFERENCE TO RELATED APPLICATION

The present application is based on and claims priority to Japanese patent application No. 2005-014948 filed on Jan. 24, 2005 in the Japan Patent Office, the entire contents of which are hereby incorporated herein by reference.

BACKGROUND OF THE INVENTION

1. Field of the Invention

Example embodiments of the present invention relate to an image forming apparatus, a fixing apparatus, a toner, and a method of preparing a toner.

2. Description of the Background Art

Methods for forming an image by developing an electrostatic latent image in an image forming apparatus, for example, electrophotographic and electrostatic recording methods, are now used in various fields. In the electrophotographic method, an electrostatic latent image is formed on a photoconductor based on image data through charging and exposing processes. The electrostatic latent image is developed with a developer into a toner image and transferred onto a recording medium, for example, paper, through developing and transfer processes. The toner image is fixed through a fixing process so that an image is formed on the recording medium.

Background image forming apparatuses, for example, copiers, facsimiles, and printers, generally include a fixing unit for fixing the toner image transferred on the recording medium.

One example of a fixing unit includes a pair of rollers, e.g., a heating roller and a pressure roller opposing to each other. A recording medium having a toner image is conveyed through a nip formed between the heating roller and the pressure roller. Heat applied by the heating roller and pressure applied by the pressure roller melt and fix the toner image on the recording medium.

Another example of a fixing unit includes the pressure roller, a fixing belt replacing the heating roller of the above example, and a pair of rollers for rotating the fixing belt. The fixing belt is looped over the pair of rollers. One of the rollers opposes the pressure roller via the fixing belt. The other roller includes a heater for heating the fixing belt from its inner circumferential surface and the pressure roller includes another heater for heating the fixing belt from its outer circumferential surface. The fixing belt can be heated more quickly than the heating roller of the above example due to its smaller volume and heat capacity. Thus, this fixing unit can be heated to a desired temperature more quickly than the above fixing unit including the heating roller after the image forming apparatus is powered on. The two heaters respectively heat the inner and outer circumferential surfaces of the fixing belt, resulting in quick increase in temperature of the fixing belt.

Yet another example of the fixing unit includes a fixing roller, a heating roller, a fixing belt formed in an endless belt shape and looped over the fixing roller and the heating roller, and a pressure roller opposing the fixing roller via the fixing belt. A heater for heating the fixing belt is placed inside any one or each of the pressure roller and the heating roller. A recording medium having a toner image is conveyed between the fixing belt and the pressure roller. The toner image on the recording medium is fixed while the recording medium passes a first fixing area where the pressure roller applies pressure to the fixing belt via the recording medium and does not apply pressure to the fixing roller via the recording medium and the fixing belt. In the first fixing area, the pressure roller applies a low pressure not creasing the recording medium. The toner image on the recording medium is also fixed while the recording medium passes a second fixing area where the pressure roller applies pressure to the fixing roller via the recording medium and the fixing belt. In the second fixing area, the pressure roller applies a level of pressure enabling a desired fixing. Thus, the recording medium is properly conveyed and the toner image is stably fixed on the recording medium even in a high speed or color image forming apparatus.

When the toner image is fixed by using the fixing belt and the pressure roller, the outer circumferential surface of the fixing belt may be charged and may attract toner particles from the recording medium. This is called an electrostatic offset.

When electrostatic offset occurs, the attracted toner particles may be transferred onto another recording medium after the fixing belt rotates for one cycle and may form an afterimage on the recording medium. To reduce or prevent this, a cleaning member (e.g., a cleaning roller) is disposed to contact the fixing belt to remove the attracted toner particles from the fixing belt. However, when a large amount of toner particles is adhered to the cleaning member, the toner particles may melt onto the fixing belt, resulting in staining and damaging the recording medium.

Image forming apparatuses using the electrophotographic and electrostatic recording methods should produce images having an improved transparency and saturation.

The developer used in the developing process in the electrophotographic method includes a one-component developer containing a magnetic toner or a non-magnetic toner and a two-component developer containing a toner and carriers.

A toner used as the developer is generally produced in a mixing-kneading-pulverizing method in which a thermoplastic resin and a pigment are dissolved, mixed, kneaded with a releasing agent for example, wax and/or a charging control agent, if necessary, and then pulverized and sized. To improve fluidity and cleaning property of the toner, inorganic or organic fine particles are added to surfaces of toner particles, if necessary.

The toner particles produced in the mixing-kneading-pulverizing method generally have no definite shape, and have a broad particle size distribution, a low fluidity and transferability, a high fixing energy, a charging amount varying depending on toner particles, and a low charging stability. An image formed with such toner particles may provide insufficient image quality.

A polymerization method is proposed to solve the above problems of the toner particles produced in the mixing-kneading-pulverizing method. The polymerization method does not include kneading and pulverizing processes, resulting in cost reduction caused by energy saving, shortened production hours, and an improved yield of products. A sharper particle size distribution can be easily obtained with toner particles produced in the polymerization method than with the toner particles produced in the mixing-kneading-pulverizing method. In the polymerization method, wax can be contained inside the toner particles to improve fluidity of the toner particles and the toner particles can be formed in a spherical shape.

However, the toner particles produced in the polymerization method have problems. A surface tension affecting the toner particles during a polymerization process produces toner particles having a sphericity higher than that of the toner particles produced in the mixing-kneading-pulverizing method. However, physical properties of the toner particles produced in the polymerization method are not sufficient. In the polymerization method, it is not easy to control (e.g., vary) a shape of the toner particles. However, the polymerization method can have an advantage in producing toner particles having an improved charging stability and transferability.

The polymerization method includes a suspension polymerization method generally used. Monomers for a binder (e.g., a binder resin) used in the suspension polymerization method may be limited to a styrene monomer and an acrylic monomer harmful to humans. Toner particles produced in the suspension polymerization method contain those monomers and may cause environmental problems. Since wax is contained inside the toner particles, a decreased amount of the toner particles are adhered to a photoconductor. However, the toner particles produced in the suspension polymerization method have a lower fixing performance than the toner particles produced in the mixing-kneading-pulverizing method. In the mixing-kneading-pulverizing method, wax is on an interface of the toner particle. In the suspension polymerization method, the wax contained inside the toner particles does not easily seep onto surfaces of the toner particles, resulting in a low fixing performance. Therefore, the toner particles produced in the suspension polymerization method (e.g., polymer toner particles) may have a disadvantage in reducing energy consumption. If an amount of the wax or a dispersed particle size of the wax is increased to improve the fixing performance of the polymer toner particles, transparency of a color image may deteriorate when the polymer toner particles are used for forming the color image. Thus, the polymer toner particles are not suitable for forming a color image on an OHP (overhead projector) transparency used for presentation.

The polymerization method further includes an emulsion polymerization method which can vary the shape of toner particles. A monomer used in the emulsion polymerization method is limited to the styrene monomer. It may be difficult to completely remove an unreacted monomer, an emulsifier, and a dispersing agent from the toner particles, causing environmental problems.

A dissolution-suspension method is also known as a toner production method. The dissolution-suspension method may have an advantage in using a polyester resin enabling fixing at a low temperature. A high-molecular-weight component is added in a process of dissolving or dispersing a resin enabling fixing at a low temperature and a colorant in a solvent. Therefore, a liquid viscosity may increase, causing problems relating to production performance. Toner particles produced in the dissolution-suspension method are formed to have a spherical shape and a patterned indented surface in order to improve cleaning performance for the toner particles. However, those toner particles having an amorphous shape without regularity may lack charging stability and may have problems in endurance and releasing, providing insufficient quality.

A dry toner particle is proposed to improve fluidity, fixability at a low temperature, and hot offset resistance. The dry toner particle includes an elongated reactant of urethane-modified polyester as a toner binder and has a practical sphericity ranging from 0.90 to 1.00. Another dry toner particle proposed may have an advantage in powder fluidity and transferability when formed as a toner particle having a small particle size as well as in heat-resistant preservation, fixability at a low temperature, and hot offset resistance. Methods for producing the above dry toner particles include a high-molecular-weight producing process of polyadding polyester prepolymer having an isocyanate group with amine in an aqueous medium.

In the polymer toner produced in any one of the above polymerization methods, however, a pigment is not properly dispersed but is unevenly dispersed in the toner. Thus, an image formed with the toner may have an inferior transparency and saturation (e.g., brightness). Particularly, when a color image is formed on an OHP transparency with the toner, the color image may become dark.

SUMMARY OF THE INVENTION

This specification describes a novel image forming apparatus. In an example embodiment of the present invention, the novel image forming apparatus includes an image forming mechanism and a fixing mechanism. The image forming mechanism is configured to form a visible image using toner on a recording sheet according to input image data. The fixing mechanism is configured to fix the visible image onto the recording sheet. The fixing mechanism includes a first roller, a second roller, a belt, a third roller, and/or an applicator. The first roller is configured to rotate. The second roller includes inside a first heater having a first heat capacity, and is configured to rotate. The belt is looped over the first and second rollers. The third roller is arranged opposite to the first roller via the belt and includes inside a second heater having a heat capacity smaller than the first heat capacity of the first heater of the second roller. The third roller is configured to apply a pressure to the belt and the first roller and to rotate in conjunction with a movement of the first roller via the belt. The applicator is arranged at a position in contact with the third roller and is configured to apply oil to a surface of the third roller.

This specification describes a novel fixing apparatus. In an example embodiment of the present invention, the novel fixing apparatus includes the first roller, the second roller, the belt, the third roller, and/or the applicator as described above.

BRIEF DESCRIPTION OF THE DRAWINGS

A more complete appreciation of the invention and the many attendant advantages thereof will be readily obtained as the same becomes better understood by reference to the following detailed description of example embodiments when considered in connection with the accompanying drawings, wherein:

FIG. 3 is a lookup table illustrating properties of toner binders for the fixing unit shown in FIG. 2; and FIGS. 4A and 4B illustrate a lookup table illustrating evaluations of toners for the fixing unit shown in FIG. 2.

DETAILED DESCRIPTION OF EXAMPLE EMBODIMENTS

Figure 1:
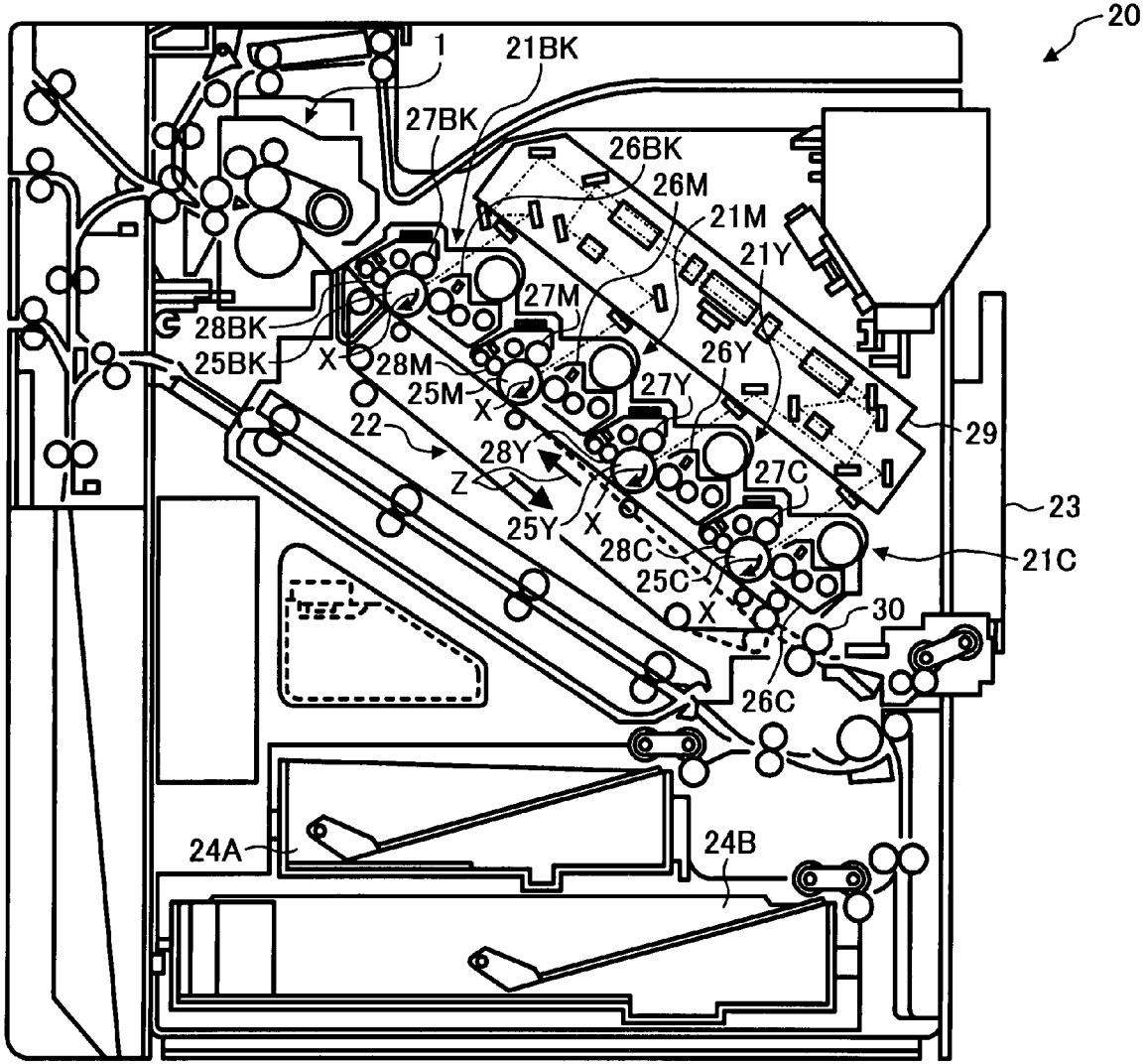
FIG. 1 is a schematic view of an image forming apparatus according to an example embodiment of the present invention.

In describing example embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, wherein like reference numerals designate identical or corresponding parts throughout the several views, particularly to FIG. 1, an image forming apparatus according to an example embodiment of the present invention is explained.

As illustrated in FIG. 1, an image forming apparatus 20 includes an exposure unit 29, image forming units 21C, 21Y, 21M, and 21BK, a bypass tray 23, paper trays 24A and 24B, a registration roller 30, a transfer unit 22, and/or a fixing unit 1.

The image forming unit 21C includes a charger 27C, a photoconductive drum 25C, a development unit 26C, and/or a cleaning unit 28C. The image forming unit 21Y includes a charger 27Y, a photoconductive drum 25Y, a development unit 26Y, and/or a cleaning unit 28Y. The image forming unit 21M includes a charger 27M, a photoconductive drum 25M, a development unit 26M, and/or a cleaning unit 28M. The image forming unit 21BK includes a charger 27BK, a photoconductive drum 25BK, a development unit 26BK, and/or a cleaning unit 28BK.

The image forming apparatus 20 is configured to function as a copier, a printer, or a facsimile capable of forming a color image or a monochrome image based on image data. The exposure unit 29 is configured to irradiate a light onto each of the photoconductive drums 25C, 25Y, 25M, and 25BK to form an electrostatic latent image on each of the photoconductive drums 25C, 25Y, 25M, and 25BK. The image forming unit 21C is configured to form a cyan toner image. The image forming unit 21Y is configured to form a yellow toner image. The image forming unit 21M is configured to form a magenta toner image. The image forming unit 21BK is configured to form a black toner image. The bypass tray 23, the paper tray 24A, and the paper tray 24B are configured to load recording sheets. The registration roller 30 is configured to feed a recording sheet conveyed from the bypass tray 23, the paper tray 24A, or the paper tray 24B onto the transfer unit 22. The transfer unit 22 is configured to convey the recording sheet so that the cyan, yellow, magenta, and black toner images are transferred from the image forming units 21C, 21Y, 21M, and 21BK onto the recording sheet. The fixing unit 1 is configured to fix the toner images transferred on the recording sheet.

The charger 27C is configured to charge a surface of the photoconductive drum 25C. The photoconductive drum 25C is configured to carry an electrostatic latent image corresponding to the cyan color formed by a light irradiated from the exposure unit 29. The development unit 26C is configured to develop with a cyan color toner the electrostatic latent image corresponding to the cyan color to form a cyan color toner image. The cleaning unit 28C is configured to remove the cyan color toner not transferred and remaining on the photoconductive drum 25C. The charger 27Y is configured to charge a surface of the photoconductive drum 25Y. The photoconductive drum 25Y is configured to carry an electrostatic latent image corresponding to the yellow color formed by a light irradiated from the exposure unit 29. The development unit 26Y is configured to develop with a yellow color toner the electrostatic latent image corresponding to the yellow color to form a yellow color toner image. The cleaning unit 28Y is configured to remove the yellow color toner not transferred and remaining on the photoconductive drum 25Y. The charger 27M is configured to charge a surface of the photoconductive drum 25M. The photoconductive drum 25M is configured to carry an electrostatic latent image corresponding to the magenta color formed by a light irradiated from the exposure unit 29. The development unit 26M is configured to develop with a magenta color toner the electrostatic latent image corresponding to the magenta color to form a magenta color toner image. The cleaning unit 28M is configured to remove the magenta color toner not transferred and remaining on the photoconductive drum 25M. The charger 27BK is configured to charge a surface of the photoconductive drum 25BK. The photoconductive drum 25BK is configured to carry an electrostatic latent image corresponding to the black color formed by a light irradiated from the exposure unit 29. The development unit 26BK is configured to develop with a black color toner the electrostatic latent image corresponding to the black color to form a black color toner image. The cleaning unit 28BK is configured to remove the black color toner not transferred and remaining on the photoconductive drum 25BK.

The image forming apparatus 20 can handle plain sheets generally used for copying as well as special sheets having a thermal capacity larger than that of the plain sheets, for example, OHP (overhead projector) transparencies, cards, postcards, thick paper having a paper weight of about 100 $g/m^2$ or more, and envelopes.

Each of the photoconductive drums 25C, 25Y, 25M, and 25BK rotates in a rotating direction X. The charger 27C, the development unit 26C, and the cleaning unit 28C are disposed in this order along a circumferential surface of the photoconductive drum 25C in the rotating direction X. The charger 27Y, the development unit 26Y, and the cleaning unit 28Y are disposed in this order along a circumferential surface of the photoconductive drum 25Y in the rotating direction X. The charger 27M, the development unit 26M, and the cleaning unit 28M are disposed in this order along a circumferential surface of the photoconductive drum 25M in the rotating direction X. The charger 27BK, the development unit 26BK, and the cleaning unit 28BK are disposed in this order along a circumferential surface of the photoconductive drum 25BK in the rotating direction X.

The light from the exposure unit 29 is irradiated onto an area on the surface of each of the photoconductive drums 25C, 25Y, 25M, and 25BK, which is between each of the chargers 27C, 27Y, 27M, and 27BK and each of the development units 26C, 26Y, 26M, and 26BK. Each of the photoconductive drums 25C, 25Y, 25M, and 25BK (e.g., an image carrier) is formed in a drum shape. However, the image carrier may be formed in a belt shape.

The transfer unit 22 rotates in a rotating direction Z. The transfer unit 22 opposes the photoconductive drums 25C, 25Y, 25M, and 25BK to form a transfer area between the transfer unit 22 and each of the photoconductive drums 25C, 25Y, 25M, and 25BK. The transfer unit 22 is disposed to slant in the image forming apparatus 20 so as to occupy less space in a horizontal direction than the transfer unit 22 horizontally disposed.

Each of the chargers 27C, 27Y, 27M, and 27BK uniformly charges the surface of each of the photoconductive drums 25C, 25Y, 25M, and 25BK. The exposure unit 29 irradiates a light onto each of the photoconductive drums 25C, 25Y, 25M, and 25BK based on image data to form an electrostatic latent image on each of the photoconductive drums 25C, 25Y, 25M, and 25BK. The development units 26C, 26Y, 26M, and 26BK respectively develop the electrostatic latent images with cyan, yellow, magenta, and black color toners to form cyan, yellow, magenta, and black color toner images. A recording sheet is fed from the bypass tray 23, the paper tray 24A, or the paper tray 24B to the registration roller 30. The registration roller 30 feeds the recording sheet to the transfer unit 22 at a timing when the cyan, yellow, magenta, and black color toner images are properly transferred onto the recording sheet to form a color toner image. The cleaning units 28C, 28Y, 28M, and 28BK respectively remove the cyan, yellow, magenta, and black color toners not transferred and remaining on the photoconductive drums 25C, 25Y, 25M, and 25BK. The recording sheet having the color toner image is fed to the fixing unit 1. The fixing unit 1 fixes the color toner image on the recording sheet.

Figure 2:
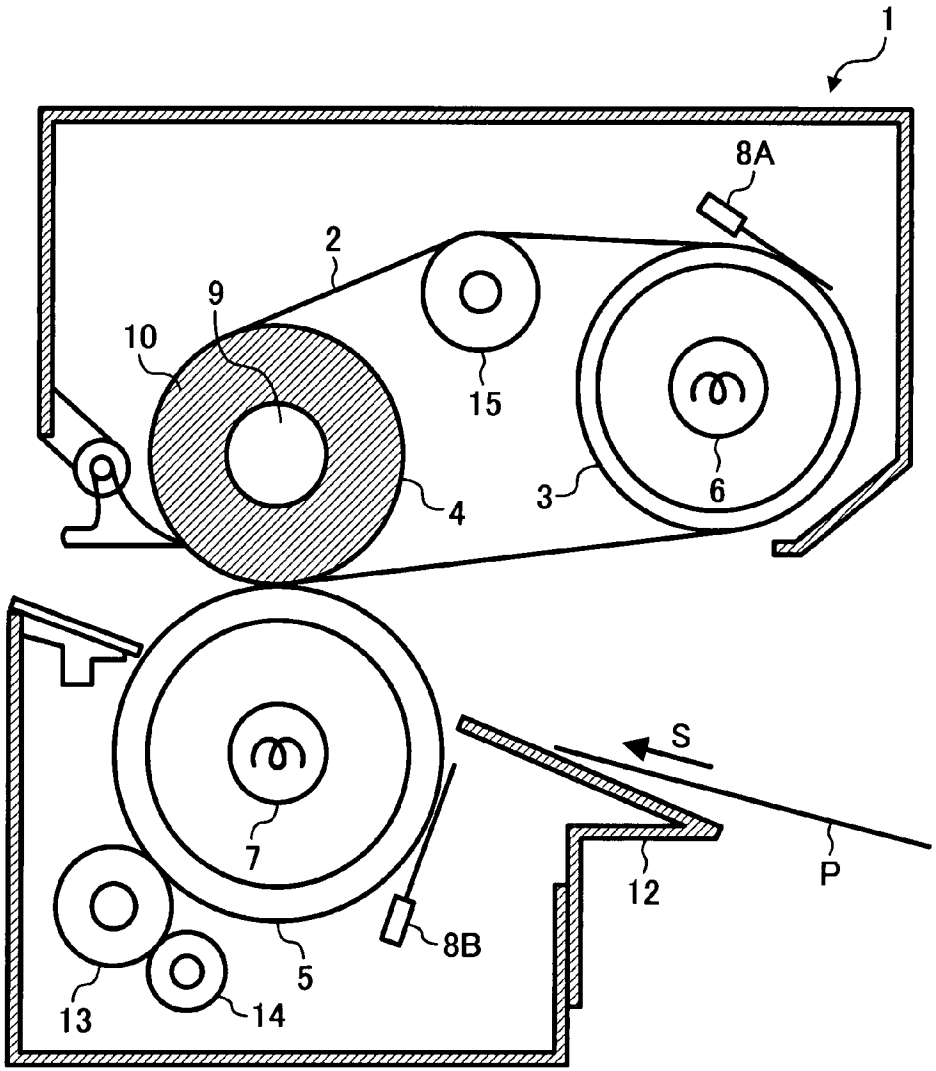
FIG. 2 is a schematic view of a fixing unit of the image forming apparatus shown in FIG. 1.

As illustrated in FIG. 2, the fixing unit 1 includes a fixing belt 2, a heating roller 3, a fixing roller 4, a pressure roller 5, heaters 6 and 7, thermistors 8A and 8B, a guide 12, an application roller 13, a cleaning roller 14, and/or a tension roller 15.

The fixing belt 2 is configured to convey a recording sheet P having a toner image and to apply heat to the recording sheet P. The heating roller 3 is configured to rotate and heat the fixing belt 2. The fixing roller 4 is configured to rotate and apply pressure to the recording sheet P via the fixing belt 2. The pressure roller 5 is configured to apply pressure to the recording sheet P. The heater 6 is configured to heat the heating roller 3. The heater 7 is configured to heat the pressure roller 5. The thermistor 8A is configured to detect a temperature of the fixing belt 2. The thermistor 8B is configured to detect a temperature of the pressure roller 5. The guide 12 is configured to guide the recording sheet P conveyed in a direction S to a nip formed between the fixing belt 2 and the pressure roller 5 facing each other. The application roller 13 is configured to apply silicon oil to the fixing belt 2 via the pressure roller 5. The cleaning roller 14 is configured to attract a toner when paper jam occurs. The tension roller 15 is configured to apply a proper tension to the fixing belt 2.

The fixing belt 2 is formed in an endless belt shape and looped over the heating roller 3 and the fixing roller 4. The pressure roller 5 opposes the fixing roller 4 via the fixing belt 2. The heaters 6 and 7 are placed inside the heating roller 3 and the pressure roller 5, respectively. The thermistors 8A and 8B oppose the fixing belt 2 and the pressure roller 5, respectively. An elastic body (not shown), for example, a spring, of the tension roller 15 applies a force to an inner circumferential surface of the fixing belt 2. Thus, the fixing belt 2 maintains a proper tension.

The fixing roller 4 includes a core 9 and an elastic layer 10. The core 9 forms a core of the fixing roller 4. The elastic layer 10 includes a heat-resistant, porous layer and covers the core 9. An elastic body (not shown), for example, a spring, applies a force in a direction pressing the fixing roller 4 toward the pressure roller 5.

The heater 6 is configured to have a heat capacity larger than that of the heater 7. One reason of this is that a heat capacity of the fixing belt 2 is smaller than that of the pressure roller 5. Another reason is that not only the heater 7 but also heat transferred from a heated surface of the fixing belt 2 can heat the pressure roller 5, so that the pressure roller 5 is heated faster than the heating roller 3 upon cold start. The heat capacities of the heaters 6 and 7 are respectively 1,100 W and 200 W when a voltage of 100 V is applied.

To reduce or prevent a charged surface of the fixing belt 2 from attracting a toner from the recording sheet P (e.g., to reduce or prevent an electrostatic offset), the application roller 13 applies silicon oil onto the surface of the fixing belt 2 so that the toner is easily released from the surface of the fixing belt 2.

The application roller 13 includes a core (not shown) covered by a surface film (not shown) including sponge foam impregnated with the silicon oil. Single-layered or double-layered semipermeable membranes having pores cover the sponge foam. The silicon oil seeps through the pores. Thus, a trace amount of the silicon oil is applied onto the pressure roller 5 opposing the application roller 13.

An amount of a toner adhered to the surface of the fixing belt 2 which was measured for an image formed without using the application roller 13 revealed a slight electrostatic offset. The image was formed with the toner and carriers according to an example, non-limiting embodiment. For example, an amount of the toner adhered to the recording sheet P was about 0.5 mg/cm$^2$. The image was formed at a speed of about 125 mm/sec at a fixing temperature of about 175 degrees centigrade.

The surface film of the application roller 13 includes a material from which toner particles adhered thereto due to paper jam are easily released so as to reduce or prevent the toner particles from being fixed onto the surface film. The toner particles adhered to the surface film may block the pores and the silicon oil may not be applied. According to an example, non-limiting embodiment, a Gore-Tex® film is used as the surface film so that the adhered toner particles are easily released from the surface film.

A temperature affects an amount of the silicon oil seeping from the application roller 13. The higher the temperature is, the more widely the amount of the silicon oil seeping from the application roller 13 varies. In an example embodiment, the application roller 13 is kept at a temperature as low as possible. According to an example, non-limiting embodiment, the application roller 13 is disposed to contact the pressure roller 5. The application roller 13 does not contact the fixing belt 2 and indirectly applies the silicon oil to the fixing belt 2 via the pressure roller 5. Thus, variation in a surface temperature of the application roller 13 can be suppressed to reduce variation in the amount of the silicon oil seeping from the application roller 13.

For example, even when the application roller 13 was disposed to contact the fixing belt 2 on an upper portion of the fixing roller 4 where the fixing belt 2 was less affected by heat generated by the heater 6, the surface temperature of the application roller 13 varied in a range of about 145 to 195 degrees centigrade. As a result, the amount of the silicon oil applied varied from about 0.04 mg to about 0.12 mg per A4, size sheet. When the application roller 13 was disposed to contact the pressure roller 5, the surface temperature of the application roller 13 varied in a range of about 165 to 180 degrees centigrade. As a result, variation in the amount of the silicon oil applied reduced to a range varying from about 0.04 mg to about 0.09 mg per A4 size sheet.

In the image forming apparatus 20 according to an example, non-limiting embodiment, a toner and carriers described below are used to cause the toner to be easily released from the fixing belt 2. Even when a substantially reduced amount of the silicon oil is applied to the surface of the fixing belt 2, a hot offset (e.g., an insufficient release) can be sufficiently reduced or suppressed.

For example, when a toner produced in a pulverization method is used, the silicon oil in an amount ranging from about 2.0 mg to about 5.0 mg per A4 size sheet is applied to the fixing belt 2 to reduce or prevent the hot offset. When the silicon oil in an amount of about 2.0 mg or less per A4 size sheet was applied to the fixing belt 2, the hot offset conspicuously occurred. When the toner and the carriers according to an example, non-limiting embodiment were used, the silicon oil applied in an amount ranging from about 0.05 mg to about 0.08 mg per A4 size sheet can reduce or prevent the electrostatic offset as well as the hot offset.

The toner used in the image forming apparatus 20 according to an example, non-limiting embodiment can be released from the fixing belt 2 even when a small amount of the silicon oil is applied. Therefore, the application roller 13 does not contact the fixing belt 2 but can indirectly apply the silicon oil to the fixing belt 2 via the pressure roller 5. When the image forming apparatus 20 configured to indirectly apply the silicon oil to the fixing belt 2 uses a toner which is not easily released from the fixing belt 2, the silicon oil is not sufficiently applied to the pressure roller 5, causing the electrostatic offset.

The cleaning roller 14 contacts the application roller 13. Thus, toner particles adhered to the surface of the application roller 13 due to paper jam are adhered to a surface of the cleaning roller 14.

When toner particles are adhered to the surface of the application roller 13 due to paper jam, the toner particles block the pores of the surface film of the application roller 13 and the silicon oil is not applied through the pores to the pressure roller 5. As a result, the silicon oil is not uniformly applied to the surface of the pressure roller 5, causing the electrostatic offset. When the toner particles adhered to the surface of the application roller 13 due to paper jam are adhered to the surface of the pressure roller 5, the toner particles are adhered to a back side of a next recording sheet P while a toner image on a front side of the recording sheet P is fixed, causing a stained back side of the recording sheet P.

To solve the above problem, the cleaning roller 14 contacts the application roller 13 in the fixing unit 1 according to an example non-limiting embodiment, so that the toner particles adhered to the surface of the application roller 13 due to paper jam are adhered to the surface of the cleaning roller 14. The cleaning roller 14 includes an inexpensive solid metal and the surface of the cleaning roller 14 cannot release the toner particles as easily as the surface of the application roller 13. Therefore, the toner particles adhered to the surface of the application roller 13 due to paper jam are adhered to the surface of the cleaning roller 14. As a result, the silicon oil can be stably applied to the pressure roller 5.

The following describes positioning of the application roller 13 and the pressure roller 5. When the heater 7 is turned on, heat is released from an upper portion of the pressure roller 5 after an outer circumferential surface of the pressure roller 5 is sufficiently heated. To reduce or prevent temperature from affecting performance of the application roller 13 as much as possible, especially to reduce or prevent the application roller 13 from being kept at a high temperature when the fixing unit 1 is stopped, the application roller 13 is disposed to contact a lower half portion of the pressure roller 5. Thus, variation in the surface temperature of the application roller 13 is reduced when the fixing unit 1 is stopped and a toner image on the recording sheet P is fixed. As a result, variation in the amount of the silicon oil applied can be reduced.

The following describes positioning of the cleaning roller 14. If the cleaning roller 14 contacts the pressure roller 5, a surface temperature of the cleaning roller 14 may increase. The toner particles adhered to the surface of the application roller 13 due to paper jam may be adhered to the surface of the cleaning roller 14. If the cleaning roller 14 contacts the pressure roller 5 and the surface temperature of the cleaning roller 4 increases, the toner particles adhered to the surface of the cleaning roller 14 may melt and may be adhered to the surface of the pressure roller 5, causing the recording sheet P to be stained with the toner particles. If the cleaning roller 14 contacts only the application roller 13 according to an example embodiment, the surface temperature of the cleaning roller 14 can be kept at a degree lower than that of the cleaning roller 14 disposed to contact the pressure roller 5. The toner particles are not released from the surface of the cleaning roller 14 as easily as from the surface of the application roller 13. Thus, the toner particles are not adhered to the surface of the application roller 13, preventing the toner particles from being adhered to the pressure roller 5 and further adhered to the recording sheet P after the toner particles are adhered to the surface of the application roller 13 due to paper jam.

An image forming apparatus 20 capable of reducing or preventing the electrostatic offset may have the fixing unit 1 configured as described above installed into the image forming apparatus 20. Thus, it may be possible to reduce or prevent the image forming apparatus 20 from outputting a stained or damaged recording sheet P and producing a faulty image.

The following describes the toner according to an example non-limiting embodiment. The toner is an electrophotographic toner including a polyester resin as a binder and a pigment colorant highly dispersed therein. The toner can produce a high quality image having an improved transparency and saturation (e.g., brightness or gloss) and can provide an improved powder fluidity, hot offset resistance, charging stability, and/or transferability.

The toner is easily released from the fixing belt 2, thereby reducing the amount of the silicon oil applied to the fixing belt 2. In the fixing unit 1 using the toner, the application roller 13 contacts the pressure roller 5 and does not contact the fixing belt 2 to indirectly apply the silicon oil to the fixing belt 2 via the pressure roller 5.

For example, the toner according to an example, non-limiting embodiment is a toner for electrophotography prepared by dissolving or dispersing a prepolymer including a modified polyester resin, a compound to elongate or cross-link with the prepolymer, and a toner constituent in an organic solvent to obtain a dissolved or dispersed liquid, elongating and/or cross-linking the dissolved or dispersed liquid in an aqueous medium to obtain a dispersion liquid, and removing a solvent from the dispersion liquid. A pigment colorant dispersed in the toner has a number average dispersed particle size not larger than about 0.5 μm. A number ratio of the pigment colorant having a number average particle size not smaller than about 0.7 μm is not greater than about 5 number percent.

The colorant dispersed in the toner may have a number average dispersed particle size not larger than about 0.3 μm and a number ratio of the colorant having a number average particle size not smaller than about 0.5 μm may not be greater than about 10 number percent.

The toner has a weight average particle size ranging from about 3.0 μm to about 7.0 μm and a particle size distribution satisfying a following inequality:

$$1.00 \leqq Dv/Dn \leqq 1.20$$

In the above inequality, Dv represents a weight average particle size and Dn represents a number average particle size.

The toner has a circularity ranging from about 0.900 to about 0.960.

A portion of a polyester resin contained in the toner which is soluble to tetrahydrofuran has a main peak in an area of a molecular weight ranging from about 2,500 to about 10,000 in a molecular weight distribution and has a number average molecular weight ranging from about 2,500 to about 50,000.

The polyester resin contained in the toner has a glass transition point of about 40 to 65 degrees centigrade and an acid number ranging from about 1 mgKOH/g to about 30 mgKOH/g.

A polyester resin unreactive to an amine is dissolved in an oily dispersion liquid.

A developer includes the toner and carriers.

The toner can be used as either a black toner for forming a monochrome image or a color toner for forming a color image.

According to an example, non-limiting embodiment, an oily dispersion liquid is obtained by at least dissolving a polyester prepolymer A having an isocyanate group, dispersing a pigment colorant, and dissolving or dispersing a releasing agent in an organic solvent. The oily dispersion liquid is dispersed in an aqueous medium in the presence of inorganic fine particles and/or polymer fine particles to obtain a dispersion liquid. The polyester prepolymer A is reacted with a polyamine and/or an amine B having an active hydrogen group in the dispersion liquid to obtain a urea-modified polyester resin C having a urea group. A fluid medium is removed from the dispersion liquid containing the urea-modified polyester resin C. Thus, the toner according to an example, non-limiting embodiment can be obtained.

The urea-modified polyester resin C has a glass transition point of about 40 to 60 degrees centigrade, for example, about 45 to 60 degrees centigrade, a number average molecular weight Mn ranging from about 2,500 to about 50,000, for example, from about 2,500 to about 30,000, and a weight average molecular weight Mw ranging from about 10,000 to about 500,000, for example, from about 30,000 to about 100,000. The toner includes, as a binder resin, the urea-modified polyester resin C having a urea bond caused by a reaction between the polyester prepolymer A and the amine B to have a high molecular weight. A colorant is highly dispersed in the binder resin.

When the pigment colorant contained in a toner particle is controlled to have a number average dispersed particle size not larger than about 0.5 μm and a number ratio of the pigment colorant having a number average particle size not smaller than about 0.7 μm is controlled to be not greater than about 5 percent, an obtained toner can have an advantage in fixability at a low temperature, charging stability, and/or fluidity and can produce a high quality image, particularly a color image having an improved transparency and gloss.

When the pigment colorant contained in toner particles is controlled to have a number average dispersed particle size not larger than about 0.3 μm and a number ratio of the pigment colorant having a number average particle size not smaller than about 0.5 μm is controlled to be not greater than about 10 percent, an obtained toner can have higher quality. The toner can have an advantage in producing an image having a high resolution and is suitable for a digital development unit. For example, the color toner according to an example, non-limiting embodiment can have an advantage in producing an image having a high resolution and an improved transparency, and can produce a high quality color image having an improved color reproduction.

To produce the above toner in which the colorant is uniformly dispersed, it may be beneficial to improve conventional toner production methods because the conventional toner production methods cannot produce the above higher quality toner.

To produce the above higher quality toner according to an example non-limiting embodiment, it may be beneficial to include a process of pulverizing the colorant (e.g., a wet pulverizing process) to produce the oily dispersion liquid containing the polyester prepolymer A, the colorant, and the releasing agent. A wet pulverizing device for performing the wet pulverizing process can be an arbitrary device as long as it can apply an impact to the colorant in the liquid so as to pulverize the colorant. Examples of wet pulverizing devices include various known wet pulverizing devices, for example, a ball mill and a bead mill.

The wet pulverizing process is performed at a temperature of about 5 to 20 degrees centigrade for example, about 15 to 20 degrees centigrade. An adjustment of wet pulverizing conditions can control a dispersed particle size and a particle size distribution of the colorant contained in toner particles within the above range. The wet pulverizing process can be applied to the dispersion liquid after reaction, if necessary.

To produce the above higher quality toner according to an example non-limiting embodiment, it is also possible to use another method in which a colorant is dispersed in high concentrations in a resin to produce master batch colorant particles. The master batch colorant particles are added to an organic solvent as a colorant material, and are stirred and dispersed in the organic solvent. Use of the master batch colorant particles can produce a toner in which a colorant having a small, dispersed particle size is uniformly dispersed to produce a color image having an improved transparency.

To produce the master batch colorant particles, a heat melting resin and a colorant are mixed and kneaded with a high shearing force at a melting temperature of the resin. A mixture obtained is cooled and solidified. Then, the solidified mixture is pulverized. Examples of the resin include a thermoplastic resin miscible in the urea-modified polyester resin C produced from the polyester prepolymer A. A polyester resin may be used according to this non-limiting embodiment. The thermoplastic resin has a softening point of about 100 to 200 degrees centigrade, for example, about 120 to 160 degrees centigrade, and a number average molecular weight Mn ranging from about 2,500 to about 50,000, for example from about 2,500 to about 30,000. A concentration of the colorant in the master batch colorant particles is about 10 to 60 weight percent for example, about 25 to 55 weight percent.

The following describes a method for measuring physical properties of a toner, for example, a dispersed particle size and a particle size distribution of a pigment colorant contained in the toner.

To measure the dispersed particle size and the particle size distribution of the colorant contained in the toner, a toner particle is embedded in an epoxy resin. The toner particle is cut into a thin slice of about 100 nm with a microtome MT6000-XL available from Meiwa Shoji, Co., Ltd. to prepare a measurement sample. The sample is photographed with a transmission electron microscope H-9000NAR available from Hitachi, Ltd. at an acceleration voltage of 100,000 V to produce a plurality of TEM (transmission electron microscope) photographs of 10,000 to 40,000 magnifications. Image information obtained from the plurality of photographs is converted into image data with an image analyzer LUZEX III available from NIRECO Corporation. Pigment colorant particles having a particle size not smaller than about 0.1 μm are selected at random and measured until sampling is performed for 300 times or more so as to calculate an average particle size and a particle size distribution.

The toner according to an example, non-limiting embodiment has a weight average particle size Dv ranging from about 3 μm to about 7 μm. A proportion Dv/Dn of the weight average particle size Dv to a number average particle size Dn is set to not less than about 1.00 and not more than about 1.20. Thus, a toner capable of producing an image having a higher resolution and/or higher quality can be obtained. To produce a higher quality image, the weight average particle size Dv of the colorant may be set in a range varying from about 3 μm to about 7 μm. The proportion Dv/Dn may be set to not less than about 1.00 and not more than about 1.20. A number ratio of the colorant having a particle size not larger than about 3 μm may be set to about 1 to 10 number percent. For example, the weight average particle size Dv may be set in a range varying from about 3 μm to about 6 μm. The proportion Dv/Dn may be set to not less than about 1.00 and not more than about 1.15. The toner produced as described above may have an advantage in heat-resistant preservation, fixability at a low temperature, and/or hot offset resistance. For example, the toner produces an image having an improved gloss when used in a color copier. When the toner is used as a two-component developer while a cyclic operation of consumption and replenishment of the toner is repeated for a long period of time, the particle size of toner particles in the two-component developer may hardly change, thereby leading to an improved and stable development even if the toner particles are stirred in the development unit 26C, 26Y, 26M, or 26BK for a long period of time.

In general, the smaller particle size a toner has, the higher quality and resolution an image produced with the toner has. However, the smaller particle size a toner has, the poorer transferability and cleaning property the toner has. When a toner has a weight average particle size smaller than that specified herein according to an example non-limiting embodiment, toner particles may adhere to surfaces of carriers contained in the two-component developer while the two-component developer is stirred for a long period of time in the development unit 26C, 26Y, 26M, or 26BK. When a toner having a small weight average particle size is used as a one-component developer, a toner film may be formed on a developing roller and toner particles may adhere to a member, for example, a blade configured to regulate the toner particles to form a thin toner layer. An amount of fine toner particles contained in the toner may substantially relate to the above problems. For example, when an amount of toner particles having a particle size not larger than about 3 μm occupies more than about 10 percent of an amount of all toner particles, the toner particles may not easily adhere to carriers and it may be difficult to maintain charging stability at a high level. When the toner has a weight average particle size larger than that specified herein according to an example non-limiting embodiment, it may be difficult to produce an image having a high resolution and high quality. When the cyclic operation of consumption and replenishment of the toner is repeated, the particle size of the toner tends to substantially change. This is also true when a proportion of the weight average particle size to the number average particle size is more than about 1.20.

The average particle size and the particle size distribution of a toner are measured in a Coulter counter method. The particle size distribution is measured with a measuring device, for example, Coulter Counter TA-II or Coulter Multisizer II available from Beckman Coulter, Inc. According to an example non-limiting embodiment, Coulter Counter TA-II was connected to an interface for outputting a number distribution and a volume distribution available from the Institute of the Japanese Union of Scientists and Engineers and a personal computer PC9801 available from NEC Corporation so as to measure the particle size distribution.

The following describes a method for measuring a number distribution and a volume distribution of toner particles. A surfactant, for example, alkyl benzene sulfonate, in an amount ranging from about 0.1 ml to about 5.0 ml serving as a dispersing agent is added to an aqueous electrolysis solution in an amount ranging from about 100 ml to about 150 ml. An example of the aqueous electrolysis solution includes an aqueous solution of NaCl at about 1 percent which is prepared by using a first grade NaCl, for example, ISOTON-II available from Beckman Coulter, Inc. A sample toner in an amount ranging from about 2 mg to about 20 mg is added to the aqueous electrolysis solution. The aqueous electrolysis solution in which the sample toner is suspended is dispersed with an ultrasonic disperser for about 1 to 3 minutes. Volumes and numbers of toner particles contained in the sample toner are measured with the measuring device by using a 100 μm aperture to calculate the number distribution and the volume distribution of the toner particles.

Following 13 channels were used to measure particle sizes not smaller than 2.00 μm and not larger than 40.30 μm. The channels included particle sizes not smaller than 2.00 μm and not larger than 2.52 μm, not smaller than 2.52 μm and not larger than 3.17 μm, not smaller than 3.17 μm and not larger than 4.00 μm, not smaller than 4.00 μm and not larger than 5.04 μm, not smaller than 5.04 μm and not larger than 6.35 μm, not smaller than 6.35 μm and not larger than 8.00 μm, not smaller than 8.00 μm and not larger than 10.08 μm, not smaller than 10.08 μm and not larger than 12.70 μm, not smaller than 12.70 μm and not larger than 16.00 μm, not smaller than 16.00 μm and not larger than 20.20 μm, not smaller than 20.20 μm and not larger than 25.40 μm, not smaller than 25.40 m and not larger than 32.00 μm, and not smaller than 32.00 μm and not larger than 40.30 μm.

The weight average particle size Dv calculated from the volume distribution of the toner particles and the number average particle size Dn calculated from the number distribution of the toner particles were used to calculate the proportion Dv/Dn.

Various methods are proposed to produce a toner having hot offset resistance, for example, a method for controlling a molecular weight distribution of a binder resin. Methods for producing a toner having contradictory properties, e.g., fixability at a low temperature and/or hot offset resistance, include a method using a binder resin having a broader molecular weight distribution and a method using a mixed resin having at least two molecular weight peaks and including a high molecular weight component having a molecular weight of hundred-thousands to millions and a low molecular weight component having a molecular weight of thousands to tens of thousands. The high molecular weight component, when it has a cross-linking structure or it is gelled, effectively produces the toner having hot offset resistance. However, it may not be preferable to add a large amount of the high molecular weight component to a toner used for forming a color image for which transparency and gloss are required. The toner according to an example non-limiting embodiment includes the urea-modified polyester resin having the urea bond as the high molecular weight component. Thus, the toner can have an improved hot offset resistance while it is transparent and glossy.

The following describes GPC (gel permeation chromatography) for measuring a molecular weight distribution of a binder resin component contained in the toner according to an example non-limiting embodiment.

A column is stabilized in a heat chamber at about 40 degrees centigrade. A THF (tetrahydrofuran) as a column solvent at about 40 degrees centigrade is flown at a flow velocity of about 1 ml per minute. A THF sample solution in an amount ranging from about 50 μl to about 200 μl containing a resin adjusted at a sample concentration of about 0.05 to 0.06 weight percent is added. The molecular weight distribution is calculated based on a relationship between a logarithmic value and a number of counts of a calibration curve created by several types of monodisperse polystyrene standard samples. The polystyrene standard samples are available from Pressure Chemical Co. or Toyo Soda Manufacturing Co. and have molecular weights of $6\times10^2$, $2.1\times10^2$, $4\times10^2$, $1.75\times10^4$, $1.1\times10^5$, $3.9\times10^5$, $8.6\times10^5$, $2\times10^6$, and $4.48\times10^6$. At least 10 polystyrene standard samples are used to create the calibration curve. An RI (refractive index) detector is used as a detector.

The molecular weight distribution of the binder resin component contained in the toner generally includes a main peak molecular weight ranging from about 2,500 to about 10,000, for example, from about 2,500 to about 8,000, for example, from about 2,500 to about 6,000. When an amount of the binder resin component having a molecular weight not more than about 1,000 increases, heat-resistant preservation of the toner tends to deteriorate. When an amount of the binder resin component having a molecular weight not less than about 30,000 increases, fixability of the toner at a low temperature tends to deteriorate. However, balance control can suppress the deterioration. The amount of the binder resin component having the molecular weight not less than about 30,000 occupies about 1 to 10 percent and for example, about 3 to 6 percent, but varies depending on toner materials. When the amount of the binder resin component having the molecular weight not less than about 30,000 occupies less than about 1 percent, hot offset resistance of the toner may not be sufficient. When the amount of the binder resin component having the molecular weight not less than about 30,000 occupies more than about 10 percent, the toner may not be sufficiently transparent and glossy. The number average molecular weight Mn of the binder resin contained in the toner ranges from about 2,500 to about 50,000. The proportion Mw/Mn of the weight average molecular weight Mw to the number average molecular weight Mn is not more than about 10. When the proportion Mw/Mn exceeds about 10, the toner may lack sharp melting property and may not be sufficiently glossy.

A circularity of the toner according to an example non-limiting embodiment is measured with a flow-type particle image analyzer FPIA-2000 available from SYSMEX CORPORATION.

An average circularity of the toner according to this non-limiting embodiment ranges from about 0.900 to about 0.960. Toner particles may have a specific shape and shape distribution. When the average circularity is less than about 0.900, the toner particles may have an amorphous shape, may not provide satisfactory transferability, and may not produce a high quality image without background fogging. The amorphous-shaped toner particles include a substantial number of contact points to a smooth medium for example, a photoconductor. The amorphous-shaped toner particles also include projecting points on which electric charge is concentrated, and have a van der Waals force and an image force stronger than those of spherical toner particles. Therefore, in an electrostatic transfer process, the spherical toner particles are selectively transferred in a toner in which the amorphous-shaped toner particles and the spherical toner particles are mixed, resulting in white spots on characters and lines on a produced image. A cleaning unit may be required to remove toner particles remaining on the photoconductor before a next developing process starts. A toner yield, e.g., a rate of a toner used for image forming, may also decrease. A circularity of a pulverized toner, which is measured with the flow-type particle image analyzer FPIA-2000, usually ranges from about 0.910 to about 0.920.

In an example embodiment an optical detection area method may be used to measure the circularity of a toner. In the optical detection area method, a suspension liquid containing toner particles passes an image detecting area on a flat plate. A CCD (charge-coupled device) camera optically detects and analyzes images of the toner particles. The optical detection area method calculates a projected area of a toner particle.

A circularity Ci of a toner particle is calculated by a following equation:

$$Ci=Cs/Cp$$

where Cp represents a circumferential length of a projected image of the toner particle, and Cs represents a circumferential length of a circle having a same area as the projected image of the toner particle.

The circularity Ci of the tone particle is measured with the flow-type particle image analyzer FPIA-2000 as an average circularity. Specifically, a surfactant as a dispersing agent, for example, alkyl benzene sulfonate in an amount ranging from about 0.1 ml to about 0.5 ml, is added in a container containing water in an amount ranging from about 100 ml to about 150 ml from which solid impurities have been removed. A measurement sample in an amount ranging from about 0.1 g to about 0.5 g is added to the water to produce a suspension liquid. The suspension liquid is dispersed for about 1 to 3 minutes with the ultrasonic disperser to produce a dispersion liquid having a concentration of about 3,000 to 10,000 particles per μl. The flow-type particle image analyzer FPIA-2000 measures shapes of the toner particles and a toner particle shape distribution.

A method for producing the toner according to an example non-limiting embodiment includes the high-molecular-weight producing process. In the process, the polyester prepolymer A having the isocyanate group is dispersed in the aqueous medium including the inorganic fine particles and/or the polymer fine particles, and is reacted with the amine B. In an example, the polyester prepolymer A having the isocyanate group can be produced by reacting a polyester, which is a polycondensate of a polyol PO and a polycarboxylic acid PC and has the active hydrogen group, with a polyisocyanate PIC. Examples of the active hydrogen group include hydroxyl groups (e.g., an alcoholic hydroxyl group and a phenolic hydroxyl group), amino groups, carboxyl groups, mercapto groups, and the like. Among those, the alcoholic hydroxyl group may be preferred.

Examples of the polyol PO include a diol DIO and a trivalent or more polyol TO. The diol DIO alone or a mixture of the diol DIO and a small amount of the trivalent or more polyol TO may be preferred. Examples of the diol DIO include alkylene glycols (e.g., ethylene glycol, 1,2-propylene glycol, 1,3-propylene glycol, 1,4-butanediol, 1,6-hexanediol, and the like), alkylene ether glycols (e.g., diethylene glycol, triethylene glycol, dipropylene glycol, polyethylene glycol, polypropylene glycol, polytetramethylene ether glycol, and the like), alicyclic diols (e.g., 1,4-cyclohexane dimethanol, hydrogenated bisphenol A, and the like), bisphenols (e.g., bisphenol A, bisphenol F, bisphenol S, and the like), alkylene oxide (e.g., ethylene oxide, propylene oxide, butylene oxide, and the like) adducts of the above alicyclic diols, alkylene oxide (e.g., ethylene oxide, propylene oxide, butylene oxide, and the like) adducts of the above bisphenols, and the like. Among those, the alkylene glycols having a carbon number of 2 to 12 and the alkylene oxide adducts of the above bisphenols may be preferred. In an example embodiment, both the alkylene oxide adducts of the above bisphenols and the alkylene glycols having the carbon number of 2 to 12 may be used. Examples of the trivalent or more polyol TO include polyvalent (e.g., trivalent to octavalent or more) aliphatic alcohols (e.g., glycerin, trimethylol ethane, trimethylol propane, pentaerythritol, sorbitol, and the like), trivalent or more polyphenols (e.g., trisphenol PA, phenol novolac, cresol novolac, and the like), alkylene oxide adducts of the above trivalent or more polyphenols, and the like.

Examples of the polycarboxylic acid PC include a dicarboxylic acid DIC and a trivalent or more polycarboxylic acid TC. The dicarboxylic acid DIC alone or a mixture of the dicarboxylic acid DIC and a small amount of the trivalent or more polycarboxylic acid TC may be preferred. Examples of the dicarboxylic acid DIC include alkylene dicarboxylic acids (e.g., succinic acid, adipic acid, sebacic acid, and the like), alkenylene dicarboxylic acids (e.g., maleic acid, fumaric acid, and the like), aromatic dicarboxylic acids (e.g., phthalic acid, isophthalic acid, terephthalic acid, naphthalene dicarboxylic acid, and the like), and the like. Among those, the alkenylene dicarboxylic acids having a carbon number of 4 to 20 and the aromatic dicarboxylic acids having a carbon number of 8 to 20 may be preferred. Examples of the trivalent or more polycarboxylic acid TC include aromatic polycarboxylic acids having a carbon number of 9 to 20 (e.g., trimellitic acid, pyromellitic acid, and the like), and the like. Examples of the polycarboxylic acid PC further include acid anhydrides of the above or lower alkyl esters (e.g., methyl ester, ethyl ester, isopropyl ester, and the like), which are reacted with the polyol PO. A ratio of the polyol PO to the polycarboxylic acid PC is represented by an equivalent ratio of the hydroxyl group to the carboxyl group, which usually ranges from about 2/1 to about 1/1, for example, ranges from about 1.5/1 to about 1/1, for example, ranges from about 1.3/1 to about 1.02/1.

Examples of the polyisocyanate PIC include aliphatic polyisocyanates (e.g., tetramethylene diisocyanate, hexamethylene diisocyanate, 2,6-diisocyanate methylcaproate, and the like), alicyclic polyisocyanates (e.g., isophorone diisocyanate, cyclohexylmethane diisocyanate, and the like), aromatic diisocyanates (e.g., tolylene diisocyanate, diphenylmethane diisocyanate, and the like), aromatic, aliphatic diisocyanates (e.g., α,α,α',α'-tetramethyl xylylene diisocyanate and the like), isocyanurates, the above polyisocyanates blocked by phenolic derivatives, oximes, caprolactams, and/or the like, and a combination of two or more substances described above.

To obtain the polyester prepolymer having the isocyanate group, a ratio of the polyisocyanate PIC to an unmodified polyester resin PE having the active hydrogen group is represented by an equivalent ratio of the isocyanate group to the hydroxyl group of the polyester having the hydroxyl group, which usually ranges from about 5/1 to about 1/1, for example, ranges from about 4/1 to about 1.2/1, for example, ranges from about 2.5/1 to about 1.5/1. When the ratio of the isocyanate group to the hydroxyl group exceeds about 5, fixability of the toner at a low temperature may deteriorate. When a molar ratio of the isocyanate group is less than about 1 and the urea-modified polyester is used, an amount of urea contained in the urea-modified polyester may decrease, resulting in deterioration of hot offset resistance of the toner. An amount of a component of the polyisocyanate PIC contained in the polyester prepolymer A having the isocyanate group at an end usually occupies about 0.5 to 40 weight percent, for example, about 1 to 30 weight percent, for example, about 2 to 20 weight percent. When the amount of the component of the polyisocyanate PIC occupies less than about 0.5 weight percent, hot offset resistance of the toner may deteriorate, and the toner may have a disadvantage in improving both heat-resistant preservation and fixability at a low temperature. When the amount of the component of the polyisocyanate PIC occupies more than about 40 weight percent, fixability of the toner at a low temperature may deteriorate.

A number of the isocyanate groups contained in one molecule of the polyester prepolymer A having the isocyanate group is usually not less than about 1, for example, ranges from about 1.5 to about 3 on average, for example, ranges from about 1.8 to about 2.5 on average. When the number of the isocyanate groups is less than about 1, a molecular weight of the urea-modified polyester obtained may decrease, resulting in deterioration of hot offset resistance of the toner.

Examples of the amine B include polyamines and monoamines having the active hydrogen group. Examples of the active hydrogen group include the hydroxyl group and the mercapto group. Examples of the amine B further include diamines b1, polyamines (e.g., trivalent or more amines) b2, amino alcohols b3, amino mercaptans b4, amino acids b5, blocked amines b6 in which the amino group of the above diamines b1, polyamines b2, amino alcohols b3, amino mercaptans b4, or amino acids b5 is blocked, and the like.

Examples of the diamines b1 include aromatic diamines (e.g., phenylene diamine, diethyltoluene diamine, 4,4'-diaminodiphenyl methane, and the like), alicyclic diamines (e.g., 4,4'-diamino-3,3'-dimethyldicyclohexyl methane, diaminocyclohexane, isophoron diamine, and the like), aliphatic diamines (e.g., ethylene diamine, tetramethylene diamine, hexamethylene diamine, and the like), and the like. Examples of the polyamines b2 include diethylene triamine, triethylene tetramine, and the like. Examples of the amino alcohols b3 include ethanol amine, hydroxyethyl aniline, and the like. Examples of the amino mercaptans b4 include aminoethyl mercaptan, aminopropyl mercaptan, and the like. Examples of the amino acids b5 include amino propionic acid, amino caproic acid, and the like. Examples of the blocked amines b6 include ketimine compounds obtained from the diamines b1, the polyamines b2, the amino alcohols b3, the amino mercaptans b4, the amino acids b5, and ketones (e.g., acetone, methyl ethyl ketone, methyl isobutyl ketone, and the like), oxazoline compounds, and the like. Among the above amines B, the diamines b1 and a mixture of the diamines b1 and a small amount of the polyamines b2 may be preferred.

To react the polyester prepolymer A with the amine B, an elongation stopper may be used to adjust the molecular weight of the urea-modified polyester, if necessary. The elongation stopper includes monoamines without the active hydrogen group (e.g., diethylamine, dibutylamine, butylamine, laurylamine, and the like), amines blocking the above (e.g., a ketimine compound), and the like. An amount of the elongation stopper can be properly selected based on a desired molecular weight of the urea-modified polyester to be generated.

A ratio of the polyester prepolymer A having the isocyanate group to the amine B is represented by an equivalent ratio of the isocyanate group (e.g., NCO) of the polyester prepolymer A having the isocyanate group to the amino group (e.g., NHx where x represents 1 or 2) of the amine B, which usually ranges from about 1/2 to about 2/1, for example, ranges from about 1.5/1 to about 1/1.5, for example, ranges from about 1.2/1 to about 1/1.2. When the ratio of NCO to NHx is more than about 2/1 or less than about 1/2, the molecular weight of the urea-modified polyester may decrease, resulting in deterioration of hot offset resistance of the toner.

When reacting the polyester prepolymer A having the isocyanate group with the amine B in the aqueous medium according to an example non-limiting embodiment, a polyester resin D unreactive to the amine B can be added to the aqueous medium, if necessary. The unreactive polyester resin D has a glass transition point of about 35 to 65 degrees centigrade, for example, about 45 to 60 degrees centigrade, and a number average molecular weight Mn ranging from about 2,000 to about 10,000, for example, from about 2,500 to about 8,000. An example of the unreactive polyester resin D includes a urea-modified polyester UMPE. The urea-modified polyester UMPE may contain a urea bond as well as a urethane bond. A molar ratio of the urea bond to the urethane bond usually ranges from about 100/0 to about 10/90, for example, ranges from about 80/20 to about 20/80, for example, ranges from about 60/40 to about 30/70. When the molar ratio is less than about 10 percent, hot offset resistance of the toner may deteriorate.

The urea-modified polyester UMPE is produced in a known technology for example, a one-shot method. A weight average molecular weight of the urea-modified polyester UMPE is usually not less than about 10,000, for example, ranges from about 20,000 to about 500,000, for example, ranges from about 30,000 to about 100,000. When the weight average molecular weight is less than about 10,000, hot offset resistance of the toner may deteriorate.

According to an example non-limiting embodiment, a toner binder may contain only the urea-modified polyester resin UMPE which is used if necessary, or both the urea-modified polyester resin UMPE and the unmodified polyester resin PE. When the toner binder contains both the urea-modified polyester resin UMPE and the unmodified polyester resin PE, the toner may improve fixability at a low temperature and produce a more glossy color image. Thus, the toner binder may contain both the urea-modified polyester resin UMPE and the unmodified polyester resin PE. An example of the unmodified polyester resin PE includes a compound produced by polycondensation of the polyol PO and the polycarboxylic acid PC. Examples of the polyol PO and the polycarboxylic acid PC include those of the urea-modified polyester resin UMPE. The unmodified polyester resin PE may have a molecular weight similar to that of the urea-modified polyester resin UMPE. The unmodified polyester resin PE may be modified by a chemical bond other than the urea bond, for example, the urethane bond. The urea-modified polyester resin UMPE and the unmodified polyester resin PE may be at least partially compatible to improve fixability at a low temperature and hot offset resistance of the toner. Therefore, the urea-modified polyester resin UMPE and the unmodified polyester resin PE have a similar polyester composition. A weight ratio of the urea-modified polyester resin UMPE to the unmodified polyester resin PE usually ranges from about 5/95 to about 80/20, for example, ranges from about 5/95 to about 30/70, for example, ranges from about 5/95 to about 25/75, for example, ranges from about 7/93 to about 20/80. When the urea-modified polyester resin UMPE occupies less than about 5 percent, hot offset resistance of the toner may deteriorate and the toner may have a disadvantage in improving both heat-resistant preservation and fixability at a low temperature.

The unmodified polyester resin PE may have a hydroxyl number not smaller than about 5 mgKOH/g. An acid number of the unmodified polyester resin PE usually ranges from about 1 mgKOH/g to about 30 mgKOH/g and for example, ranges from about 5 mgKOH/g to about 20 mgKOH/g. When the unmodified polyester resin PE has the acid number, the toner can easily be negative-charged and can have an affinity to the recording sheet P while a toner image is fixed on the recording sheet P, resulting in an improved fixability of the toner at a low temperature. However, when the acid number of the unmodified polyester resin PE exceeds about 30 mgKOH/g, charging stability of the toner tends to deteriorate especially when an environmental condition changes. In a polyaddition reaction between the polyester prepolymer A and the amine B, variation in the acid number may cause variation in toner particle size in a granulation process, resulting in difficulty in emulsification.

According to an example non-limiting embodiment, a glass transition point of the toner binder is usually about 45 to 65 degrees centigrade for example, about 45 to 60 degrees centigrade. When the glass transition point is lower than about 45 degrees centigrade, heat resistance of the toner may deteriorate. When the glass transition point is higher than about 65 degrees centigrade, the toner may provide insufficient fixability at a low temperature.

Various known pigments can be used as the pigment colorant according to an example non-limiting embodiment. Examples of the pigment colorant include carbon black, nigrosine, black ironoxide, Naphthol Yellow S, Hanza Yellow (10G, 5G, and G), Cadmium Yellow, yellow iron oxide, loess, chrome yellow, Titan Yellow, polyazo yellow, Oil Yellow, Hanza Yellow (GR, A, RN, and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, Permanent Red (F2R, F4R, FRL, FRLL, and F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc white, lithopone, and a mixture of those. The pigment colorant content in the toner is usually about 1 to 15 weight percent for example, about 3 to 10 weight percent.

As described above, the pigment colorant according to an example non-limiting embodiment may be used as master batch colorant particles complexed with a resin. Examples of the binder resin mixed and kneaded with the pigment colorant for producing a master batch include polymers of styrenes (e.g., polystyrene, poly-p-chlorostyrene, polyvinyltoluene, and the like) and substitutions of the above styrenes, styrene copolymers (e.g., styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-α-chloro methyl methacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, styrene-maleate copolymer, and the like), polymethyl methacrylate, polybutyl methacrylate, polyvinyl chloride, polyvinyl acetate, polyethylene, polypropylene, polyester, epoxy resins, epoxy polyol resins, polyurethane, polyamide, polyvinyl butyral, polyacrylic resins, rosin, modified rosin, terpene resins, aliphatic or alicyclic hydrocarbon resins, aromatic petroleum resins, chlorinated paraffin, paraffin wax, and the like as well as the above polyester resins modified and not modified. Any one of the above substances or a mixture of the above substances can be used.

The master batch can be produced by mixing and kneading the resin and the colorant for the master batch with a high shearing force. In an example embodiment, an organic solvent can be used to enhance an interaction between the colorant and the resin. A flushing method may also be used. In the flushing method, a water-based paste containing water of the colorant is mixed and kneaded with the resin and the organic solvent. The colorant is transferred to the resin. The water and the organic solvent are removed to use a wet cake of the colorant without drying it. A high shearing dispersion device, for example, a three-roll mill, may be used for mixing and kneading.

The toner according to an example non-limiting embodiment includes a releasing agent (e.g., wax) as well as the toner binder and the colorant. Various known waxes can be used as the releasing agent, for example, polyolefin waxes (e.g., polyethylene wax, polypropylene wax, and the like), long chain hydrocarbons (e.g., paraffin wax, Sasol wax, and the like), waxes having a carbonyl group, and the like. Among those, the waxes having the carbonyl group may be preferred. Examples of the waxes having the carbonyl group include polyalkanoic acid esters (e.g., carnauba wax, montan wax, trimethylolpropane tribehenate, pentaerythritol tetrabehenate, pentaerythritol diacetate dibehenate, glycerin tribehenate, 1,18-octade-canediol distearate, and the like), polyalkanol esters (e.g., tristearyl trimellitate, distearyl maleate, and the like), polyalkanoic acid amides (e.g., ethylenediamine dibehenylamide and the like), polyalkylamides (e.g., trimellitic acid tristearylamide and the like), dialkyl ketones (e.g., distearyl ketone and the like), and the like. Among those waxes having the carbonyl group, the polyalkanoic acid esters may be preferred. A melting point of the wax is usually about 40 to 160 degrees centigrade, for example, about 50 to 120 degrees centigrade, for example, about 60 to 90 degrees centigrade. The wax having the melting point lower than about 40 degrees centigrade may negatively affect heat-resistant preservation of the toner. The wax having the melting point higher than about 160 degrees centigrade may easily cause a cold offset during fixing at a low temperature. A melting viscosity of the wax, when measured at a temperature that is 20 degrees centigrade higher than the melting point, for example, ranges from about 5 cps to about 1,000 cps for example, ranges from about 10 cps to about 100 cps. The wax having the melting viscosity higher than about 1,000 cps may hardly improve hot offset resistance and fixability at a low temperature of the toner. The wax content in the toner is usually about 0 to 40 weight percent for example, about 3 to 30 weight percent.

The toner according to an example non-limiting embodiment may include a charging control agent, if necessary. Various known charging control agents can be used as the charging control agent, for example, nigrosine dyes, triphenylmethane dyes, metal-complex compound dyes including chrome, chelate molybdate pigments, rhodamine dyes, alkoxy amines, quarternary ammonium salts (including fluorine-modified quarternary ammonium salts), alkylamides, phosphor and phosphoric compounds, tungsten and tungstic compounds, fluorochemical surfactants, salicylic acid metallic salts, metallic salts of salicylic acid derivatives, and the like. Example products of the charging control agent include BONTRON 03 as a nigrosine dye, BONTRON P-51 as a quarternary ammonium salt, BONTRON S-34 as an azo dye including metal, BONTRON E-82 as an oxynaphthoic acid metal-complex compound, BONTRON E-84 as a salicyclic acid metal-complex compound, and BONTRON E-89 as a phenolic condensation, which are available from Orient Chemical Industries, Ltd. Specific examples of the charging control agent further include TP-302 and TP-415 as a molybdenum complex of quarternary ammonium salt, which is available from Hodogaya Chemical, Co., Ltd., COPY CHARGE PSY VP2038 as a quarternary ammonium salt, COPY BLUE PR as a triphenyl methane derivative, and COPY CHARGE NEG VP2036 and COPY CHARGE NX VP434 as a quarternary ammonium salt, which are available from Hoechst AG, LRA-901 and LR-147 as a boron complex, which are available from Japan Carlit Co., Ltd., copper phthalocyanine, perylene, quinacridone pigments, azo pigments, high polymers having a sulfonic acid group, the carboxyl group, and a functional group for example, a quaternary ammonium salt, and the like.

An amount of the charging control agent according to an example non-limiting embodiment is not uniquely determined, but is determined based on type of the binder resin, additives used if necessary, and a toner production method including a dispersion method. The amount of the charging control agent is about 0.1 to 10 parts by weight for example, about 0.2 to 5 parts by weight against the binder resin of 100 parts by weight. When the amount of the charging control agent exceeds about 10 parts by weight, the toner may be overly charged. Effects of the charging control agent may decrease and the toner may be strongly electrostatic-attracted to the developing roller, resulting in a decreased fluidity of the developer and a decreased image density. The charging control agent and the releasing agent can be melted, mixed, and kneaded with the master batch and the resin. The charging control agent can also be added when dissolved and dispersed in the organic solvent.

Inorganic fine particles can be used as an additive for supporting fluidity, developing ability, and chargeability of toner particles containing the colorant according to an example non-limiting embodiment. A primary particle size of the inorganic fine particle may range from about 5 mμ to about 2 μm for example, ranges from about 5 mμ to about 500 mμ. A specific surface area measured in a BET (Brunauer, Emmet, Teller) method may be from about 20 $m^2/g$ to about 500 $m^2/g$. The organic fine particles used in the toner may occupy about 0.01 to 5.0 weight percent for example, occupy about 0.01 to 2.0 weight percent. Examples of the inorganic fine particles include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, and the like.

High polymer fine particles can also be used as the additive. Examples of the high polymer fine particles include polystyrene copolymers, methacrylic acid ester copolymers, and acrylic acid ester copolymers obtained by soap-free emulsion polymerization, suspension polymerization, or dispersion polymerization, silicon, benzo guanamine, or nylon obtained by polycondensation, and polymer particles obtained by thermosetting resins.

A surface treatment agent may be used as another additive for applying a surface treatment on a toner particle to improve hydrophobic property of the toner particle and to reduce or prevent deterioration of fluidity or chargeability of the toner particle even at a high humidity. Examples of the surface treatment agent include a silane coupling agent, a silylation agent, a silane coupling agent having an alkyl fluoride group, an organic titanate coupling agent, an aluminum coupling agent, a silicone oil, a modified silicone oil, and the like.

A cleaning agent may be used as yet another additive for removing the developer remaining on the photoconductor or a primary transfer medium after a toner image is transferred. Examples of the cleaning agent include fatty acid metallic salts (e.g., zinc stearate, calcium stearate, stearic acid, and the like), polymer fine particles produced by soap-free emulsion polymerization (e.g., polymethyl methacrylate fine particle, polystyrene fine particle, and the like), and the like. The polymer fine particles for example, have a narrow particle size distribution and a volume average particle size ranging from about 0.01 μm to about 1 μm.

The following describes a method for producing the toner according to an example non-limiting embodiment. In an oily dispersion liquid preparation process, the polyester prepolymer A having the isocyanate group, a colorant, and a releasing agent are dissolved or dispersed in an organic solvent to prepare an oily dispersion liquid. In a wet pulverization process, the oily dispersion liquid is pulverized with a wet pulverization device for about 30 to 120 minutes to pulverize and uniformly disperse the colorant in the oily dispersion liquid.

In a dispersion (e.g., emulsification) process, the oily dispersion liquid is dispersed (e.g., emulsified) in an aqueous medium in the presence of inorganic fine particles and/or polymer fine particles to prepare an oil-in-water dispersion (e.g., emulsified) liquid. In a reaction process, the polyester prepolymer A having the isocyanate group is reacted with the amine B in the dispersion liquid to prepare a urea-modified polyester resin C having a urea bond.

The organic solvent contains a polyester resin dissolved therein and is insoluble, or hardly or slightly soluble in water. A boiling point of the organic solvent is usually about 60 to 150 degrees centigrade for example, about 70 to 120 degrees centigrade. Examples of the organic solvent include ethyl acetate, methyl ethyl ketone, and the like.

The above-described master batch colorant particles can be used as the colorant so that the colorant can be effectively and uniformly dispersed. The unreactive polyester resin D which is unreactive to the amine B can be dissolved as a supplementary component in the organic solvent. The unreactive polyester resin D can be dispersed in the aqueous medium.

A dispersion device for dispersing the oily dispersion liquid in the aqueous medium is not limited and known dispersion devices using a low-speed shearing, a high-speed shearing, a friction, a high-pressure jet, and a ultrasonic methods can be used as the dispersion device. The dispersion device using the high-speed shearing method can be used to produce a dispersion particle having a particle size ranging from about 2 μm to about 20 μm. A number of rotations of the dispersion device using the high-speed shearing method is not restricted, but usually ranges from about 1,000 rpm to about 30,000 rpm and for example, ranges from about 5,000 rpm to about 20,000 rpm. A dispersion time period is not restricted, but is usually about 0.1 to 5 minutes for a batch method. A dispersion temperature is usually about 0 to 150 degrees centigrade under pressure for example, about 40 to 98 degrees centigrade. High temperatures may be preferred to produce the dispersion liquid having a low viscosity and to easily disperse the dispersion liquid.

An amount of the aqueous medium against 100 parts by weight of toner solids, for example, the polyester prepolymer A, the colorant, the releasing agent, and the unreactive polyester resin D contained in the oily dispersion liquid, is usually about 50 to 2,000 parts by weight for example, about 100 to 1,000 parts by weight. When the amount of the aqueous medium is less than about 50 parts by weight, the toner solids may not be properly dispersed and toner particles having a predetermined particle size may not be obtained. When the amount of the aqueous medium is more than about 2,000 parts by weight, toner particles may not be produced at a reasonable cost. A dispersing agent can be used, if necessary. The dispersing agent can be used to create a sharp particle size distribution and to perform stable dispersion. It may preferable be that it takes time as short as possible before dispersing the oily dispersion liquid in the aqueous medium after the oily dispersion liquid is wet-pulverized.

The aqueous medium may include water only or water and a solvent miscible with water. Examples of the solvent miscible with water include alcohols (e.g., methanol, isopropanol, ethylene glycol, and the like), dimethylformamide, tetrahydrofuran, cellosolves (e.g., methyl cellosolve and the like), lower ketones (e.g., acetone, methyl ethyl ketone, and the like), and the like.

Various surfactants (e.g., emulsifiers) can be used as a dispersing agent for emulsifying and dispersing an oily phase containing the toner solids in a liquid containing water (e.g., an aqueous medium). Examples of the surfactants include anionic surfactants (e.g., alkyl benzene sulfonate, α-olefin sulfonate, ester phosphate, and the like), amine salt cationic surfactants (e.g., alkylamine salt, amino alcohol fatty acid derivative, polyamine fatty acid derivative, imidazoline, and the like), quaternary ammonium salt cationic surfactants (e.g., alkyl trimethyl ammonium salt, dialkyl dimethyl ammonium salt, alkyl dimethyl benzyl ammonium salt, pyridinium salt, alkyl isoquinolinium salt, benzethonium chloride, and the like), nonionic surfactants (e.g., fatty acid amide derivative, polyalcohol derivative, and the like), amphoteric surfactants (e.g., alanine, dodecyldi(aminoethyl)glycin, di(octylaminoethyl)glycin, N-alkyl-N,N-dimethyl ammonium betaine, and the like), and the like.

A small amount of a surfactant having a fluoroalkyl group can be effectively used according to an example non-limiting embodiment. Examples of an anionic surfactant having the fluoroalkyl group include fluoroalkyl carboxylic acids having a carbon number of 2 to 10 and metallic salts thereof, disodium perfluorooctane sulfonylglutamate, sodium 3-[omega-fluoroalkyl (C6 to C11) oxy]-1-alkyl (C3 to C4) sulfonate, sodium 3-[omega-fluoro alkanoyl (C6 to C8)-N-ethylamino]-1-propanesulfonate, fluoroalkyl (C11 to C20) carboxylic acids and metallic salts thereof, perfluoro alkyl carboxylic acids (C7 to C13) and metallic salts thereof, perfluoro alkyl (C4 to C12) sulfonate and metallic salts thereof, perfluorooctane diethanolamide sulfonate, N-propyl-N-(2 hydroxyethyl) perfluorooctane sulfonamide, perfluoro alkyl (C6 to C10) sulfonamide propyl trimethyl ammonium salts, perfluoro alkyl (C6 to C10)-N-ethyl sulfonyl glycin salts, monoperfluoro alkyl (C6 to C16) ethyl ester phosphate, and the like.

Example products of the anionic surfactant include Surflon S-111, S-112, and S-113 available from Asahi Glass Co., Ltd., Fluorad FC-93, FC-95, FC-98, and FC-129 available from Sumitomo 3M Limited, Unidyne DS-101 and DS-102 available from Daikin Industries, Ltd., Megaface F-110, F-120, F-113, F-191, F-812, and F-833 available from Dainippon Ink and Chemicals, Incorporated, EFTOP EF-102, EF-103, EF-104, EF-105, EF-112, EF-123A, EF-123B, EF-306A, EF-501, EF-201, and EF-204 available from JEMCO Inc., FTERGENT F-100 and F-150 available from NEOS Company Limited, and the like.

Examples of the cationic surfactant include primary, secondary, and tertiary aliphatic amic acids, aliphatic, quaternary ammonium salts (e.g., perfluoroalkyl (C6 to C10) sulfonamide propyl trimethyl ammonium salt and the like), benzalkonium salts, benzethonium chloride, pyridinium salts, imidazolinium salts, and the like. All of the above have a fluoroalkyl group. Example products of the cationic surfactant include Surflon S-121 available from Asahi Glass Co., Ltd., Fluorad FC-135 available from Sumitomo 3M Limited, Unidyne DS-202 available from Daikin Industries, Ltd., Megaface F-150 and F-824 available from Dainippon Ink and Chemicals, Incorporated, EFTOP EF-132 available from JEMCO Inc., FTERGENT F-300 available from NEOS Company Limited, and the like.

Various known inorganic compounds which are insoluble or hardly soluble in water can be used as the inorganic fine particles in the aqueous medium. Examples of the inorganic compounds include tricalcium phosphate, calcium carbonate, titanium oxide, colloidal silica, hydroxy apatite, and the like.

Various known fine particles which are insoluble or hardly soluble in water can be used as the polymer fine particles in the aqueous medium. Examples of the fine particles include hydrophobic high polymer fine particles (e.g., hydrocarbon resins, fluorocarbon resins, silicone resins, and the like).

The above fine particles usually have a particle size smaller than that of toner particles. A particle size ratio of volume average particle size of the fine particles to volume average particle size of the toner particles ranges from about 0.001 to about 0.3 to keep uniform particle size. When the particle size ratio is more than about 0.3, the fine particles may not be effectively attracted onto surfaces of the toner particles. Thus, a particle size distribution of the toner particles tends to become broad. The volume average particle size of the fine particles can be properly adjusted within the above range so that toner particles of a desired particle size can be obtained. For example, the volume average particle size of the fine particles may be adjusted in a range varying from about 0.0025 μm to about 1.5 μm and may be adjusted in a range varying from about 0.005 μm to about 1.0 μm to obtain toner particles having a volume average particle size of about 5.0 μm. The volume average particle size of the fine particles may be adjusted in a range varying from about 0.005 μm to about 3.0 μm and may be adjusted in a range varying from about 0.05 μm to about 2.0 μm to obtain toner particles having a volume average particle size of about 10.0 μm.

Various hydrophilic high polymer substances which form high polymer protective colloids in the aqueous medium can be added as a dispersion stabilizer in the aqueous medium. Examples of monomers constituting the high polymer substances include acids (e.g., acrylic acid, methacrylic acid, α-cyanoacrylic acid, α-cyanomethacrylic acid, itaconic acid, crotonic acid, fumaric acid, maleic acid, maleic anhydride, and the like), acrylic and methacrylic monomers having the hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylic ester, diethylene glycol monomethacrylic ester, glycerin monoacrylic ester, glycerin monomethacrylic ester, N-methylolacrylamide, N-methylolmethacrylamide, and the like), vinyl alcohols and ethers thereof (e.g., vinyl methyl ether, vinyl ethyl ether, vinyl propyl ether, and the like), esters of vinyl alcohol and a compound having the carboxyl group (e.g., vinyl acetate, vinyl propionate, vinyl butyrate, and the like), acrylamides, methacrylamides, diacetone acrylamides, and methylol compounds thereof, acid chlorides (e.g., acrylic acid chloride, methacrylic acid chloride, and the like), nitrogen compounds (e.g., vinyl pyridine, vinyl pyrrolidone, vinyl imidazole, ethyleneimine, and the like), homopolymers and copolymers (e.g., heterocyclic nitrogen compounds), and the like.

Examples of the high polymer substances, which may be used according to an example non-limiting embodiment, include polyoxyethylene compounds (e.g., polyoxyethylene, polyoxypropylene, polyoxyethylene alkylamine, polyoxypropylene alkylamine, polyoxyethylene alkylamide, polyoxypropylene alkylamide, polyoxyethylene nonylphenylether, polyoxyethylene laurylphenylether, polyoxyethylene stearylphenylester, polyoxyethylene nonylphenylester, and the like), cellulose compounds (e.g., methyl cellulose, hydroxyethyl cellulose, hydroxypropyl cellulose, and the like), and the like.

To remove the liquid medium from the emulsified dispersion liquid obtained after the polyaddition reaction between the polyester prepolymer A and the amine B, a liquid medium removing process can include a process of gradually increasing a temperature of the emulsified dispersion liquid to remove the organic solvent by evaporating it. A circularity of toner particles can be controlled by a strength of stirring the emulsified dispersion liquid before removing the organic solvent and a time period required for removing the organic solvent. When the organic solvent is slowly removed, a sphericity of the toner particles may increase and the circularity of the toner particles may be not less than about 0.980. When the emulsified dispersion liquid is strongly stirred and the organic solvent is removed in a short period of time, the toner particles may be formed in a convexo-concave shape or may not have a uniform shape and the circularity of the toner particles may range from about 0.900 to about 0.950. When the organic solvent is removed while the emulsified dispersion liquid obtained after the dispersion and reaction processes is strongly stirred at a temperature of about 30 to 50 degrees centigrade in a stirring vessel, the circularity of the toner particles can be controlled within a range varying from about 0.850 to about 0.990. This may result from contraction in volume caused by rapid removal of the organic solvent for example, ethyl acetate added while the toner particles are formed.

The emulsified dispersion liquid can also be sprayed in a dry atmosphere to completely remove the organic solvent so that toner particles are formed and to remove the aqueous dispersing agent by evaporating it. Examples of the dry atmosphere include gases in which air, nitrogen, carbon dioxide, combustion gas, and the like are heated, for example, include airflows heated to a temperature equaling or exceeding a boiling point of the liquid medium having a boiling point higher than that of any other constituent. Processing requiring a short time period by using a spray dryer, a belt dryer, or a rotary kiln can produce high quality toner particles. A time period required after the reaction until the removal of the organic solvent may be as short as possible and is usually within about 25 hours.

When a substance soluble in an acid or alkaline medium, for example, calcium phosphate salt, is used as the inorganic fine particles, the inorganic fine particles can be removed from the toner particles by dissolving the inorganic fine particles in an acid for example, hydrochloric acid and rinsing them. The inorganic fine particles can also be removed by a zymolytic method.

When the dispersing agent is used, the dispersing agent can remain on a surface of the toner particle. The dispersing agent may be removed by washing after the reaction between the polyester prepolymer A and the amine B to improve chargeability of the toner particle.

A solvent in which the polyester prepolymer A and the urea-modified polyester UMPE are soluble can be added to the aqueous medium to decrease a viscosity of the dispersion liquid after the reaction. The solvent may be used to obtain a sharp particle size distribution. The solvent can be easily removed if the solvent is volatile and has a boiling point lower than about 100 degrees centigrade. Examples of the solvent include a single substance (e.g., toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone, and the like) or a mixture of two or more of the above substances. Examples of the solvent may include aromatic solvents (e.g., toluene, xylene, and the like), halogenated hydrocarbons (e.g., methylene chloride, 1,2-dichloroethane, chloroform, carbon tetrachloride, and the like), and the like. An amount of the solvent against 100 parts by weight of the polyester prepolymer A is usually about 0 to 300 parts by weight, for example, about 0 to 100 parts by weight, for example, about 25 to 75 parts by weight. When the solvent is used, the solvent is removed by heating the solvent under a normal or reduced pressure after the reaction between the polyester prepolymer A and the amine B.

A time period of the reaction between the polyester prepolymer A and the amine B is selected based on a reactivity of a combination of a structure of the isocyanate group of the polyester prepolymer A with the amine B, but usually ranges from about 10 minutes to about 40 hours and may be about 2 to 24 hours. A temperature of the reaction is usually about 0 to 150 degrees centigrade and may be about 40 to 98 degrees centigrade. Known catalysts can be used, if necessary. Examples of the catalysts include dibutyltin laurate, dioctyltin laurate, and the like.

To wash and dry by maintaining a broad particle size distribution of the toner particles in the emulsified dispersion liquid after the reaction between the polyester prepolymer A and the amine B, the toner particles can be sized according to a desired particle size distribution. In an example, fine particles are removed in the liquid with a cyclone, a decanter, a centrifugal separator, or the like. The toner particles in a powder form may be sized after being dried. However, the toner particles can be effectively sized in the liquid. Removed fine or coarse toner particles are reused to produce toner particles in a mixing-kneading process. In an example, the fine or coarse toner particles may be wet. The dispersing agent may be removed from the dispersion liquid as much as possible while the toner particles are sized.

When the dried toner particles are mixed with different types of particles for example, releasing agent fine particles, charging control agent fine particles, and fluidizing agent fine particles, if necessary, a mechanical impact is applied to the mixed particles to stabilize and integrate the different types of particles on the surfaces of the toner particles. Thus, it is possible to reduce or prevent the different types of particles from separating from surfaces of complex particles obtained.

Specifically, example methods for applying the mechanical impact to the mixed particles include a method in which a wheel rotating at a high speed applies an impact to the mixed particles and a method in which the mixed particles are thrown into a high-speed airflow and accelerated so that a particle hits another particle or the complex particles hit an appropriate plate. Example devices for applying the mechanical impact to the mixed particles include an device obtained by modifying an ong mill available from Hosokawa Micron Corporation or an I-type mill available from Nippon Pneumatic Mfg. Co. to generate a reduced pulverizing air pressure, a hybridization system available from Nara Machinery, Co., Ltd., a Kryptron system available from Kawasaki Heavy Industries, Ltd., an automatic mortar, and the like.

To use the toner according to an example non-limiting embodiment as a two-component developer, magnetic carriers can be mixed with the toner. A content ratio between the magnetic carriers and the toner contained in the two-component developer may be about 100 parts by weight of the magnetic carriers against 1 to 10 parts by weight of the toner. The magnetic carriers include known carriers having a particle size ranging from about 20 μm to about 200 μm, for example, iron powders, ferrite powders, magnetite powders, and magnetic resin carriers. Examples of a coating material for covering the magnetic carrier include amino resins (e.g., urea-formaldehyde resin, melamine resin, benzoguanamine resin, urea resin, polyamide resin, epoxy resin, and the like), polyvinyl and polyvinylidene resins (e.g., acrylic resin, polymethyl methacrylate resin, polyacrylonitrile resin, polyvinyl acetate resin, polyvinyl alcohol resin, polyvinyl butyral resin, and the like), polystyrene resins (e.g., polystyrene resin, styrene-acrylic copolymer resin, and the like), halogenated olefin resins (e.g., polyvinyl chloride and the like), polyester resins (e.g., polyethylene terephthalate resin, polybutylene terephthalate resin, and the like), polycarbonate resins, polyethylene resins, polyvinyl fluoride resins, polyvinylidene fluoride resins, polytrifluoroethylene resins, polyhexafluoropropylene resins, copolymers of vinylidenefluoride and acrylic monomer, vinylidenefluoride-vinylfluoride copolymers, fluoroterpolymers (e.g., terpolymer of tetrafluoroethylene, vinylidenefluoride, and nonfluorinated monomer, and the like), silicone resins, and the like. The coating resin may contain conductive powders and the like, if necessary. Examples of the conductive powders include metal powders, carbon black, titanium oxide, tin oxide, zinc oxide, and the like. The conductive powders may have an average particle size not larger than about 1 μm. When the average particle size is larger than about 1 μm, it may be difficult to control electrical resistance.

The toner according to an example non-liming embodiment can be used as a one-component magnetic toner or a one-component non-magnetic toner without the carriers.

The following describes examples of the toner according to an example non-limiting embodiment. FIG. 3 illustrates properties of the example toners.

An additive polyester for a first example was prepared as below.

An adduct of bisphenol A with 2 moles of ethylene oxide in an amount of 690 parts by weight and terephthalic acid in an amount of 230 parts by weight were polycondensated for about 10 hours at about 210 degrees centigrade under a normal pressure in a reaction vessel including a condenser, a stirrer, and a nitrogen inlet. The polycondensated materials were reacted for about 5 hours under a pressure reduced by from about 10 mmHg to about 15 mmHg, and then cooled down to about 160 degrees centigrade. Phthalic anhydride in an amount of 18 parts by weight was added to the cooled materials and reacted for about 2 hours to produce an unmodified polyester A1 having a weight average molecular weight Mw of 85,000.

A prepolymer for the first example was prepared as below.

The adduct of bisphenol A with 2 moles of ethylene oxide in an amount of 800 parts by weight, isophthalic acid in an amount of 160 parts by weight, terephthalic acid in an amount of 60 parts by weight, and dibutyltin oxide in an amount of 2 parts by weight were put into a reaction vessel including a condenser, a stirrer, and a nitrogen inlet, and reacted for about 8 hours at about 230 degrees centigrade under a normal pressure. The reacted materials were further reacted for about 5 hours under a pressure reduced by from about 10 mmHg to about 15 mmHg while being dehydrated, and then cooled down to about 160 degrees centigrade. Phthalic anhydride in an amount of 32 parts by weight was added to the cooled materials and reacted for about 2 hours. The reacted materials were cooled down to about 80 degrees centigrade and reacted with isophorone diisocyanate in an amount of 170 parts by weight in ethyl acetate for about 2 hours to produce a prepolymer B1 having the isocyanate group having a weight average molecular weight Mw of 35,000.

A ketimine compound for the first example was prepared as below.

Isophorone diamine in an amount of 30 parts by weight and methyl ketone in an amount of 70 parts by weight were put into a reaction vessel including a stirring bar and a thermometer and reacted for about 5 hours at about 50 degrees centigrade to produce a ketimine compound C1.

A toner for the first example was prepared as below.

The prepolymer B1 in an amount of 14.3 parts by weight, the polyester A1 in an amount of 55 parts by weight, and ethyl acetate in an amount of 78.6 parts by weight were put into a beaker, and stirred and dissolved. Rice wax (e.g., a releasing agent) in an amount of 10 parts by weight having a melting point of about 83 degrees centigrade, and a copper phthalocyanine blue pigment in an amount of 4 parts by weight were added and stirred for about 5 minutes at about 40 degrees centigrade at a speed of about 12,000 rpm with a T.K. homo mixer. The stirred materials were pulverized for about 30 minutes at about 20 degrees centigrade with a bead mill to produce a toner material oily dispersion liquid D1.

Ion-exchanged water in an amount of 306 parts by weight, a suspension liquid containing 10 percent of tricalcium phosphate in an amount of 265 parts by weight, and sodium dodecylbenzenesulfonate in an amount of 0.2 parts by weight were put into a beaker to produce a water dispersed liquid E1. While the water dispersed liquid E1 was stirred at the speed of about 12,000 rpm with the T.K. homo mixer, the toner material oily dispersion liquid D1 and the ketimine compound C1 in an amount of 2.7 parts by weight were added to cause urea reaction.

An organic solvent was removed from the reacted liquid having a viscosity of about 3,500 mP·s within about an hour at about 50 degrees centigrade or lower under a reduced pressure. Then, the reacted liquid was filtered, washed, dried, and wind-sized to produce mother toner particles F1 in a spherical shape.

The mother toner particles F1 in an amount of 100 parts by weight and a charging control agent (e.g., BONTRON E-84 available from Orient Chemical Industries, Ltd.) in an amount of 0.25 parts by weight were put into a Q-type mixer available from Mitsui Mining Co., Ltd. and mixed at a peripheral speed of about 50 m/sec of a turbine wheel. The turbine wheel was rotated for 2 minutes and stopped for 1 minute as a cycle. The cycle was repeated for 5 times so that the materials put in the Q-type mixer were mixed for 10 minutes in total.

Hydrophobic silica (e.g., H2000 available from Clariant (Japan) K.K.) in an amount of 0.5 parts by weight was added and mixed at a peripheral speed of about 15 m/sec of the turbine wheel to produce a toner G1 in the cyan color. The turbine wheel was rotated for 30 seconds and stopped for 1 minute as a cycle. The cycle was repeated for 5 times. An average dispersed particle size of the pigment colorant was 0.40 μm. A number ratio of particles having a particle size not smaller than 0.7 μm was 3.5 percent.

Master batch particles in the magenta color for a second example were prepared as below.

Water in an amount of 600 parts by weight and a Pigment Red 57 hydrated cake containing a 50 percent solid content in an amount of 200 parts by weight were sufficiently stirred with a flusher. A polyester resin in an amount of 1,200 parts by weight having an acid number of 3 mgKOH/g, a hydroxyl number of 25 mgKOH/g, a number average molecular weight Mn of 3,500, a ratio Mw/Mn of a weight average molecular weight Mw to a number average molecular weight Mn of 4.0, and a glass transition point of 60 degrees centigrade was added, mixed, and kneaded for about 30 minutes at about 150 degrees centigrade. Xylene in an amount of 1,000 parts by weight was added, mixed, and kneaded for about an hour. After the water and the xylene were removed, the mixed materials were flat-rolled, cooled, pulverized with a pulverizer, and passed twice through a three-roll mill to produce master batch particles MB-1M in the magenta color having an average particle size of 0.2 μm.

A prepolymer for the second example was prepared as below.

The adduct of bisphenol A with 2 moles of ethylene oxide in an amount of 856 parts by weight, isophthalic acid in an amount of 200 parts by weight, terephthalic acid in an amount of 20 parts by weight, and dibutyltin oxide in an amount of 4 parts by weight were put into a reaction vessel including a condenser, a stirrer, and a nitrogen inlet, and reacted for about 6 hours at about 250 degrees centigrade under a normal pressure. The reacted materials were further reacted for about 5 hours under a pressure reduced by from about 50 mmHg to about 100 mmHg while being dehydrated, and then cooled down to about 160 degrees centigrade. Phthalic anhydride in an amount of 18 parts by weight was added to the cooled materials and reacted for about 2 hours. The reacted materials were cooled down to about 80 degrees centigrade and reacted with isophorone diisocyanate in an amount of 170 parts by weight in ethyl acetate for about 2 hours to produce a prepolymer B2 having the isocyanate group having a weight average molecular weight Mw of 25,000.

A toner for the second example was prepared as below.

The prepolymer B2 in an amount of 15.4 parts by weight, the polyester A1 in an amount of 50 parts by weight, and ethyl acetate in an amount of 95.2 parts by weight were put into a beaker, and stirred and dissolved. Carnauba wax in an amount of 10 parts by weight having a molecular weight of 1,800, an acid number of 2.5 mgKOH/g, and a needle penetration degree of about 1.5 mm at about 40 degrees centigrade, and the master batch particles MB-1M in an amount of 10 parts by weight were added and stirred at about 85 degrees centigrade at a speed of about 10,000 rpm with a T.K. homo mixer. The stirred materials were wet-pulverized with a bead mill in a manner similar to that described above in the first example to produce a toner material oily dispersion liquid D2.

Mother toner particles F2 in a spherical shape were produced in a manner similar to that described above in the first example except for using a water dispersed liquid E2 obtained in a manner similar to that described above in the first example.

A toner G2 was produced in a manner similar to that described above in the first example except for using BONTRON E-89 available from Orient Chemical Industries Ltd. instead of BONTRON E-84 as a charging control agent. An average dispersed particle size of the pigment colorant contained in the toner G2 was 0.25 μm. A number ratio of particles having a particle size not smaller than 0.5 μm was 1.0 percent.

A prepolymer for a third example was prepared as below.

The addict of bisphenol A with 2 moles of ethylene oxide in an amount of 755 parts by weight, isophthalic acid in an amount of 195 parts by weight, terephthalic acid in an amount of 15 parts by weight, and dibutyltin oxide in an amount of 4 parts by weight were put into a reaction vessel including a condenser, a stirrer, and a nitrogen inlet, and reacted for about 8 hours at about 220 degrees centigrade under a normal pressure. The reacted materials were further reacted for about 5 hours under a pressure reduced by from about 50 mmHg to about 100 mmHg while being dehydrated, and then cooled down to about 160 degrees centigrade. Phthalic anhydride in an amount of 10 parts by weight was added to the cooled materials and reacted for about 2 hours. The reacted materials were cooled down to about 80 degrees centigrade and reacted with isophorone diisocyanate in an amount of 170 parts by weight in ethyl acetate for about 2 hours to produce a prepolymer B3 having the isocyanate group having a weight average molecular weight Mw of 25,000.

A toner for the third example was prepared as below.

The prepolymer B3 in an amount of 15.4 parts by weight, the polyester A1 in an amount of 50 parts by weight, and ethyl acetate in an amount of 95.2 parts by weight were put into a beaker, and stirred and dissolved. Carnauba wax in an amount of 10 parts by weight having the molecular weight of 1,800, the acid number of 2.5 mgKOH/g, and the needle penetration degree of about 1.5 mm at about 40 degrees centigrade, and the master batch particles MB-1M in an amount of 15 parts by weight were added and stirred at about 85 degrees centigrade at a speed of about 14,000 rpm with a T.K. homo mixer so as to be uniformly dispersed. The stirred materials were wet-pulverized for about 60 minutes at about 15 degrees centigrade with a bead mill to produce a toner material oily dispersion liquid D3.

Ion-exchanged water in an amount of 465 parts by weight, a suspension liquid containing 10 percent of sodium carbonate in an amount of 245 parts by weight, and sodium dodecylbenzenesulfonate in an amount of 0.4 parts by weight were put into a beaker and stirred to produce a water dispersed liquid E3. A temperature of the water dispersed liquid E3 was increased to about 40 degrees centigrade. While the water dispersed liquid E3 was stirred at the speed of about 12,000 rpm with the T.K. homo mixer, the toner material oily dispersion liquid D3 was added and stirred for about 10 minutes. Then, a ketimine compound C3 in an amount of 2.7 parts by weight was added and reacted. An organic solvent was removed from the reacted liquid within about an hour at about 40 degrees centigrade. Then, the reacted liquid was filtered, washed, and dried in a manner similar to that described above in the second example to produce mother toner particles F3 in a spherical shape.

A toner G3 was produced in a manner similar to that described above in the first example except for using the mother toner particles F3. An average dispersed particle size of the pigment colorant contained in the toner G3 was 0.15 μm. A number ratio of particles the particle size not smaller than 0.5 μm was 3.0 percent.

A toner binder for a fourth example was prepared as below.

The adduct of bisphenol A with 2 moles of ethylene oxide in an amount of 354 parts by weight, isophthalic acid in an amount of 166 parts by weight, and dibutyltin oxide in an amount of 2 parts by weight as a catalyst were poly-condensed to produce a comparative toner binder H11 having a glass transition point of 57 degrees centigrade.

A toner for the fourth example was prepared as below.

The comparative toner binder H11 in an amount of 100 parts by weight, an ethyl acetate solution in an amount of 200 parts by weight, the copper phthalocyanine blue pigment in an amount of 4 parts by weight, and the rice wax used in the first example in an amount of 5 parts by weight were put into a beaker and stirred at about 50 degrees centigrade at the speed of about 12,000 rpm with a T.K. homo mixer to produce a comparative dispersed liquid I11. A comparative toner J11 having a volume average particle size of 6 μm was produced in a manner similar to that described above in the first example except for using the comparative dispersed liquid I11. An average dispersed particle size of the pigment colorant contained in the comparative toner J11 was 0.70 μm. A number ratio of particles having a particle size not smaller than 0.7 μm was 35.0 percent.

A toner binder for a fifth example was prepared as below.

The adduct of bisphenol A with 2 moles of ethylene oxide in an amount of 343 parts by weight, isophthalic acid in an amount of 166 parts by weight, and dibutyltin oxide in an amount of 2 parts by weight were put into a reaction vessel including a condenser, a stirrer, and a nitrogen inlet, and reacted for about 8 hours at about 230 degrees centigrade under a normal pressure. The reacted materials were further reacted for about 5 hours under a pressure reduced by from about 10 mmHg to about 15 mmHg, and then cooled down to about 80 degrees centigrade. Toluene diisocyanate in an amount of 14 parts by weight was added to toluene and reacted for about 5 hours at about 110 degrees centigrade. An inorganic solvent was removed to produce a urethane-modified polyester having a peak molecular weight of 7,000. The adduct of bisphenol A with 2 moles of ethylene oxide in an amount of 363 parts by weight and isophthalic acid in an amount of 166 parts by weight were poly-condensed in a manner similar to that described above in the first example to produce an unmodified polyester having a peak molecular weight of 3,800 and an acid number of 7 mgKOH/g. The urethane-modified polyester in an amount of 350 parts by weight and the unmodified polyester in an amount of 650 parts by weight were dissolved and mixed in the toluene. An inorganic solvent was removed to produce mother toner particles of a comparative toner binder H12 having a glass transition point of 58 degrees centigrade.

A toner for the fifth example was prepared as below.

The comparative toner binder H12 in an amount of 100 parts by weight and the master batch particles used in the second example in an amount of 10 parts by weight and the carnauba wax in an amount of 10 parts by weight were added to produce a toner as described below. The added materials were premixed with a Henschel mixer, and then mixed and kneaded with a continuous mixer/kneader. The kneaded mixture was pulverized with a jet pulverizer and sized with an air current type sizing device to produce toner particles having a volume average particle size of 6 μm. The toner particles in an amount of 100 parts by weight, hydrophobic silica in an amount of 0.5 parts by weight, and hydrophobic titanium oxide in an amount of 0.5 parts by weight were mixed with the Henschel mixer to produce a comparative toner J12. An average dispersed particle size of the pigment colorant contained in the comparative toner J12 was 0.70 μm. A number ratio of particles having a particle size not smaller than 0.5 μm was 15.0 percent.

FIG. 4 illustrates evaluations of the example toners.

A glass transition point was measured as below.

A glass transition point was measured with TG-DSC system TAS-100 available from Rigaku Corporation.

A test sample of about 10 mg was put into an aluminum sample container. The aluminum sample container was placed on a holder unit and set in an electric furnace. The test sample was heated up to about 150 degrees centigrade from a room temperature at a speed of about 10 degrees centigrade per minute, and was kept at about 150 degrees centigrade for about 10 minutes. The test sample was cooled down to the room temperature, and was kept at the room temperature for about 10 minutes. The test sample was heated again up to about 150 degrees centigrade at a speed of about 10 degrees centigrade per minute under a nitrogen atmosphere to perform a DSC (differential scanning calorimetry) measurement. A glass transition point was calculated based on a contact point of a tangent line of an endothermic curve near the glass transition point and a base line by using an analysis system of the system TAS-100.

An acid number was measured as below.

An acid number was measured in accordance with JISK 0070. When the test sample was not dissolved, dioxane, tetrahydrofuran, or the like was used as a solvent.

A fluidity was measured as below.

A bulk density in a unit of g/ml was measured with a powder tester available from Hosokawa Micron Corporation. The better fluidity a toner has, the higher bulk density the toner has. The bulk density of lower than 0.25 g/ml was evaluated as being very poor. The bulk density of 0.25 g/ml to lower than 0.30 g/ml was evaluated as being poor. The bulk density of 0.30 g/ml to lower than 0.35 g/ml was evaluated as being good. The bulk density of 0.35 g/ml or higher was evaluated as being very good.

A lower-limit fixing temperature was measured as below.

Test copying was performed on recording sheets TYPE 6200 available from Ricoh Co., Ltd. with a copying machine MF-200 available from Ricoh Co., Ltd. including a Teflon® roller as a fixing roller of a modified fixing unit. A temperature of the fixing roller, at which a 70 percent or higher image density remained after a fixed image was scrubbed with a pat, was measured as a lower-limit fixing temperature.

A hot offset temperature was measured as below.

Fixing was evaluated as described above for measuring the lower-limit fixing temperature. Whether a hot offset occurred on a fixed mage or not was visually checked. A temperature of the fixing roller, at which the hot offset occurred, was measured as a hot offset temperature.

A gloss temperature was measured as below.

Fixing was evaluated with a fixing unit of a color copying machine PRETER 550 available from Ricoh Co., Ltd. A temperature of the fixing roller, at which a 60-degree angle gloss on a fixed image was not less than about 10 percent, was measured as a gloss temperature.

A haze was measured as below.

A haze was measured with a direct-reading haze computer HGM-2DP.

The toner according to example non-limiting embodiments produces a higher-quality, higher-resolution image and/or has an advantage in fixability at a lower temperature and/or hotter offset resistance. The image forming apparatus and the fixing unit using a toner according to example non-limiting embodiments can produce an image having an improved transparency and/or saturation. Even when a color image was formed on an OHP transparency, the formed image may have sufficient transparency. The toner according to example non-limiting embodiments may also have an advantage in charging stability and/or color reproduction.

The present invention has been described above with reference to example embodiments. Note that the present invention is not limited to the details of example embodiments described above, but various modifications and improvements are possible without departing from the spirit and scope of the invention. It is therefore to be understood that within the scope of the appended claims, the present invention may be practiced otherwise than as specifically described herein. For example, elements and/or features of different illustrative embodiments may be combined with each other and/or substituted for each other within the scope of the present invention and appended claims.

What is claimed is:

1. An image forming apparatus, comprising:

an image forming mechanism configured to form a visible image using toner on a recording sheet according to input image data; and a fixing mechanism configured to fix the visible image onto the recording sheet, the fixing mechanism including:

a first roller configured to rotate;

a second roller including a first heater inside the second roller having a first rating, and configured to rotate;

a belt looped over the first and second rollers;

a third roller arranged opposite to the first roller via the belt, including a second heater inside the third roller having a rating smaller than the first rating of the first heater of the second roller, and configured to apply pressure to the belt and the first roller and to rotate in conjunction with a movement of the first roller via the belt; and an applicator arranged at a position in contact with the third roller and configured to apply oil to a surface of the third roller.

2. The image forming apparatus according to claim 1, wherein the third roller receives the recording sheet having the visible image which is transported in a direction from the second roller to the first roller toward a nip between the first roller and the third roller.

3. The image forming apparatus according to claim 1, wherein the applicator applies the oil not more than about 0.15 mg per A4 size recording medium.

4. The image forming apparatus according to claim 1, further comprising:

a cleaner contacting the applicator and configured to clean a surface of the applicator.

5. The image forming apparatus according to claim 4, wherein the applicator is disposed between the third roller and the cleaner.

6. The image forming apparatus according to claim 1, wherein a center of the applicator is disposed lower than an axis of the third roller.

7. The image forming apparatus according to claim 1, wherein the toner includes a polymer toner having a polyester resin.

8. The image forming apparatus according to claim 7, wherein the polymer toner includes a colorant having a number average dispersed particle size not larger than about 0.5 μm and a number ratio of the colorant having a number average particle size not smaller than about 0.7 μm is not more than about 5 number percent.

9. The image forming apparatus according to claim 7, wherein the polymer toner includes a colorant having a number average dispersed particle size not larger than about 0.3 μm and a number ratio of the colorant having a number average particle size not smaller than about 0.5 μm is not more than about 10 number percent.

10. The image forming apparatus according to claim 7, wherein the polymer toner has a weight average particle size ranging from about 3.0 μm to about 7.0 μm and a particle size distribution satisfying a following inequality:

$$1.00 \leqq Dv/Dn \leqq 1.20$$

where Dv represents a weight average particle size and Dn represents a number average particle size.

11. The image forming apparatus according to claim 7, wherein the polymer toner has a circularity ranging from about 0.900 to about 0.960.

12. The image forming apparatus according to claim 7, wherein a portion of a polyester resin contained in the polymer toner which is soluble to tetrahydrofuran has a main peak in an area of a molecular weight ranging from about 2,500 to about 10,000 in a molecular weight distribution and has a number average molecular weight ranging from about 2,500 to about 50,000.

13. The image forming apparatus according to claim 7, wherein a polyester resin contained in the polymer toner has a glass transition point of about 40 to 65 degrees centigrade and an acid number ranging from about 1 mgKOH/g to about 30 mgKOH/g.

14. A fixing apparatus comprising:

a first roller configured to rotate;

a second roller including a first heater inside the second roller having a first rating, and configured to rotate;

a belt looped over the first and second rollers;

a third roller arranged opposite to the first roller via the belt, including a second heater inside the third roller having a rating smaller than the first rating of the first heater of the second roller, and configured to apply pressure to the belt and the first roller and to rotate in conjunction with a movement of the first roller via the belt; and an applicator arranged at a position in contact with the third roller and configured to apply oil to a surface of the third roller.

15. The fixing apparatus according to claim 14, wherein the third roller receives a recording sheet having a visible image which is transported in a direction from the second roller to the first roller toward a nip between the first roller and the third roller.

16. An image forming apparatus, comprising:

an image forming mechanism configured to form a visible image using toner on a recording sheet according to input image data; and the fixing apparatus of claim 14, configured to fix the visible image onto the recording sheet.

* * * * *